US006073073A

United States Patent [19]

Kitamura et al.

[11] Patent Number: 6,073,073

[45] **Date of Patent: *Jun. 6, 2000**

[54] AIR/FUEL RATIO CONTROL SYSTEM FOR AN INTERNAL COMBUSTION ENGINE

[75] Inventors: Toru Kitamura; Hiroshi Kitagawa; Shusuke Akazaki, all of Wako, Japan

[73] Assignee: Honda Giken Kogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/882,029

[22] Filed: Jun. 25, 1997

[30] Foreign Application Priority Data

Jun. 25, 1996 [JP] Japan ..... 8-184030

[51] Int. Cl.[7] ..... F01N 3/00; G06G 7/70

[52] U.S. Cl. ..... 701/103; 701/102; 701/104; 60/276; 60/277; 60/285; 123/698

[58] Field of Search ..... 701/101, 102, 701/104, 105, 103; 123/681, 694, 690, 696, 673, 679, 695, 684, 480, 674, 680, 687, 691, 703, 698, 568.26, 488, 692, 492, 682; 60/274, 276, 285, 277

[56] References Cited

U.S. PATENT DOCUMENTS

| | | | |
|---|---|---|---|
| 4,947,818 | 8/1990 | Kamohara et al. | 60/276 |
| 5,056,491 | 10/1991 | Tsukamoto | 123/492 |
| 5,090,199 | 2/1992 | Ikuta et al. | 60/276 |
| 5,152,270 | 10/1992 | Miyamoto | 123/692 |
| 5,209,214 | 5/1993 | Ikuta et al. | 123/698 |
| 5,247,445 | 9/1993 | Miyano et al. | 123/488 |
| 5,363,648 | 11/1994 | Akazaki et al. | 60/276 |
| 5,426,935 | 6/1995 | Ogawa et al. | 60/276 |
| 5,558,075 | 9/1996 | Maki et al. | 123/680 |
| 5,558,076 | 9/1996 | Maki et al. | 123/687 |
| 5,606,959 | 3/1997 | Maki et al. | 123/673 |
| 5,615,550 | 4/1997 | Ogawa et al. | 60/276 |
| 5,692,485 | 12/1997 | Maki et al. | 123/684 |
| 5,720,265 | 2/1998 | Maki et al. | 123/680 |
| 5,785,037 | 7/1998 | Maki et al. | 123/684 |

FOREIGN PATENT DOCUMENTS

| | | |
|---|---|---|
| 0 571 182 A2 | 11/1993 | European Pat. Off. . |
| 0 671 554 A2 | 9/1995 | European Pat. Off. . |
| 3-185244 | 8/1991 | Japan . |
| 7-247886 | 9/1995 | Japan . |

OTHER PUBLICATIONS

Automatica, vol. 10, pp. 353–379 of XP 000566006, "A Survey of Model Reference Adaptive Techniques, Theory and Applications" (by I.D., LANDAU) Jan. 1974.

*Primary Examiner*—Jacques H. Louis-Jacques
*Attorney, Agent, or Firm*—Arent Fox Kintner Plotkin & Kahn, PLLC

[57] ABSTRACT

A system for controlling an air/fuel ratio of an internal combustion engine, including a feedback control loop having an adaptive controller (STR controller) that receives as inputs a desired value r and a controlled variable y output from the plant (engine) and an adaptation mechanism that estimates adaptive parameters. The STR controller calculates a feedback correction coefficient KSTR, as an output u based upon at least the adaptive parameters, for correcting a basic amount of fuel supply calculated by retrieving mapped data, prepared beforehand, such that the controlled variable y converges to the desired value r. The system is configured such that the controlled variable y is determined based upon the detected air/fuel ratio KACT and a desired air/fuel ratio KCMD so that the desired value r is a predetermined value. More specifically, the controlled variable is determined to be a ratio between the detected air/fuel ratio and the desired air/fuel ratio such that the desired value r is 1.0 or thereabout. With this arrangement, when the desired air/fuel ratio is changed or corrected frequently, the estimation of the adaptive parameters is not affected, thereby improving the stability of air/fuel ratio control.

24 Claims, 15 Drawing Sheets

TiM-F(k)
KTOTAL
(KEGR)
(KPUG)
(KTW)
etc.
Tcyl(k)
Tout(k)
Fuel adhesion compensator
Tout-F(k)
Plant (engine)
400
CAT
94
LAF
28
CAT
54
O2
30
CAT
56
Filter
58
KACT
93
Filter
92
Filter
300
300
KACT(k)/KCMD(k-d')
KACT(k)/KCMD(k-d')
y(k)
y(k)
PID
STR
r(k)
u(k)
u(k)
r(k)
Switch
KCMD
KSTR
or
KLAF
(KFB)
KCMDM
Fixed value (1.0)
VO2M
60
Filter
Z-d'
KCMD
KCMD correction
KCMDM TiM-F(k)
KTOTAL (KEGR) (KPUG) (KTW) etc.
Tcyl(k)
Tout(k)
Fuel adhesion compensator
Tout-F(k)
Plant (engine)
400
CAT
94
LAF
CAT
54
28
CAT
O2
56
30
CAT
O2
98
Filter
58
KACT
Filter
93
Filter
92
300
300
KACT(k)/KCMD(k-d')
y(k)
KACT(k)/KCMD(k-d')
y(k)
PID
STR
r(k)
u(k)
u(k)
r(k)
KCMD
Switch
KSTR or KLAF (KFB)
KCMDM
Fixed value (1.0)
Z-d'
VO2M
Filter
60
Filter
500
KCMD
PID
KCMD correction
KCMDM

AIR/FUEL RATIO CONTROL SYSTEM FOR AN INTERNAL COMBUSTION ENGINE

BACKGROUND OF THE INVENTION

1. Field of the Invention

The present invention relates to an air/fuel ratio control system for an internal combustion engine having an adaptive controller which calculates a feedback correction coefficient to correct the amount of fuel supplied to the engine such that the detected air/fuel ratio converges to a desired air/fuel ratio.

2. Description of the Related Art

Conventionally, it is known to install an air/fuel ratio sensor in an exhaust system of an internal combustion engine having a catalyst (catalytic converter) which is provided at the engine exhaust. The air/fuel ratio sensor detects the air/fuel ratio of the engine exhaust and is used to control the amount of fuel supplied to the engine (the fuel injection amount) in a closed-loop manner such that a detected air/fuel ratio converges to a stoichiometric air/fuel ratio, since the purification efficiency of the catalyst becomes maximum at or around the stoichiometric air/fuel ratio.

The assignee proposed in Japanese Laid-Open Patent Application No. Hei 7(1995)-247886 the above described control system using an adaptive controller in which a basic amount of fuel (basic fuel injection amount) was calculated a) by retrieving 20 mapped data, prepared beforehand, using engine parameters indicative of engine operation such as engine speed, and b) by correcting the basic amount of fuel by using a feedback correction coefficient calculated by the adaptive controller. Specifically, the adaptive controller was configured to receive the detected air/fuel ratio (referred to as KACT) as the controlled variable y and the desired air/fuel ratio (referred to as KCMD) as the desired value r, and to calculate the feedback correction coefficient (referred to as KSTR) as an output u such that the detected air/fuel ratio KACT becomes equal to a desired air/fuel ratio KCMD.

More specifically, as illustrated in FIG. 14, the adaptive controller was defined by a control law expressed in a recursion or recurrence formula and had an adaptation mechanism that estimates adaptive parameters (system parameters or controller parameters) $\hat{\theta}(k)$ expressed as a vector (transpose vector) which estimated or identified the dynamic characteristics of the controlled object or plant (the engine). Based on the estimated adaptive parameters $\hat{\theta}(k)$, the adaptive controller calculated the feedback correction coefficient KSTR(k). As shown, the adaptive parameters $\hat{\theta}$ comprises elements of b0, r1, r2, r3 and s0 if the dead time (or delay time) d of the system is assumed to be 3 (3rd order).

Moreover, it has been proposed in Japanese Laid-Open Patent Application No. Hei 3 (1991)-185244 to install both a wide-range air/fuel ratio sensor (sometimes referred to as a universal sensor that detects the air/fuel ratio ranging from lean to rich) at a location upstream of the catalyst and an $O_2$ sensor at a location downstream of the catalyst in the engine exhaust, and to correct or determine the desired air/fuel ratio within a range (the so-called catalyst window) in response to the output of the $O_2$ sensor, thereby maximizing the catalyst purification efficiency. The amount of fuel supplied to the engine was then controlled in response to the corrected desired air/fuel ratio and the output of the wide-range air/fuel ratio sensor. In the technique disclosed, the controlled object is modeled and an optimum regulator is designed for controlling the amount of fuel supplied to the engine.

With regard to the above-mentioned air/fuel ratio control system previously proposed by the assignee, the inventors tested the response of the detected air/fuel ratio KACT((k) on an actual engine when the desired air/fuel ratio KCMD (k–d') was stepwise changed, while keeping the engine parameters unchanged (i.e., at the engine speed of 2800 rpm under a negative manifold pressure of −150 mmHg). Contrary to what was expected, it was found that the detected air/fuel ratio KACT(k) did overshoot the desired air/fuel ratio KCMD(k–d'), as illustrated in FIG. 15(*a*). FIGS. 15(*b*) to 15 (*f*) show the response of the elements of the adaptive parameters $\hat{\theta}$ at that time.

Here, "k" means a sampling number in a discrete-time series, and more precisely an air/fuel ratio control cycle, and "KCMD(k–d')" means the desired air/fuel ratio corresponding to the detected air/fuel ratio KACT(k) but earlier from the time k by the dead time $d^1$. The dead time is generally expressed as d and is specifically expressed as d'. It should be noted here that, to simplify calculation, the desired air/fuel ratio and the detected air/fuel ratio are both expressed, throughout the description, as the equivalence ratio, i.e., as $$Mst/M=1/\lambda$$

where, Mst is a stoichiometric air/fuel ratio; M is A/F (A is an air mass flow rate; F is a fuel mass flow rate); and $\lambda$ an excess air factor. In the test results shown in FIG. 15(*a*), the desired air/fuel ratio was varied 0.98 to 1.02, and centered at 1.0 in terms of the equivalence ratio.

As is clear from the figures, all elements except for b0 varied with respect to time. Since the desired air/fuel ratio KCMD was used as the desired value r in the calculation of the adaptive parameters, the change of the desired air/fuel ratio caused the adaptive parameters to fluctuate.

Thus, when the desired value input to the adaptive controller was changed frequently, this acted as a disturbance, causing the calculated adaptive parameters to fluctuate. Since the adaptive parameters are used in calculating the feedback correction coefficient, the calculated feedback correction coefficient would not be free from the adaptive parameters fluctuation. This would degrade air/fuel ratio control and lower the adaptive controller stability.

The above is an example. The problem will similarly happen when the desired air/fuel ratio is changed or perturbed in response to the operating conditions of the vehicle (such as the engine load, the engine speed and engine coolant temperature, etc.), or when the desired air/fuel ratio is repeatedly corrected within the catalyst window in response to the output of the $O_2$ sensor installed downstream of the catalyst so as to maximize the catalyst purification efficiency, as proposed in the above reference (3-185244).

BRIEF SUMMARY OF THE INVENTION

An object of the invention is therefore to solve the above problem and to provide an air/fuel ratio control system for an internal combustion engine having an adaptive controller with an adaptation mechanism for estimating the adaptive parameters that calculates a correction coefficient for correcting the amount of fuel supply on the basis of the adaptive parameters, in which, even when the desired air/fuel ratio is frequently changed or corrected, the adaptive controller is configured to be free from the change of the desired air/fuel ratio and to operate stably, thus ensuring stable air/fuel ratio control and improving the stability of the adaptive controller.

In order to achieve the object, there is provided a system for a system for controlling an air/fuel ratio of an internal combustion engine, comprising an air/fuel ratio detecting means for detecting an air/fuel ratio KACT of exhaust gas generated by the engine at least based upon an output of an air/fuel ratio sensor located in an exhaust system of the engine, engine operating condition detecting means for detecting engine operating conditions including at least engine speed and engine load, basic fuel supply amount calculating means for calculating a basic amount of fuel supply to be supplied to the engine based upon at least the detected engine operating conditions, feedback correction coefficient calculating means operatively coupled to said air/fuel ratio detecting means and having an adaptive controller which receives as inputs a desired value r and a controlled variable y and an adaptation mechanism which estimates adaptive parameters, said feedback correction coefficient calculating means for calculating a feedback correction coefficient KSTR as an output u based upon at least the adaptive parameters for correcting the basic amount of fuel supply calculated by said basic fuel supply amount calculating means such that the controlled variable y converges to the desired value r, output fuel amount determining means, operatively coupled to said basic fuel amount calculating means and feedback correction coefficient calculating means, for correcting the basic amount of fuel supply calculated by said basic fuel supply amount calculating means by the feedback correction coefficient KSTR to determine an output amount of fuel supply and fuel supplying means, operatively coupled to said output fuel amount determining means, for supplying the output amount of fuel supply to the engine.

In the system, controlled variable determining means is provided for determining the controlled variable y based upon the detected air/fuel ratio KACT and a desired air/fuel ratio KCMD such that the desired value r is a predetermined value.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Embodiments of the invention, given by way of example only, will now be explained with reference to the drawings.

Figure 1:
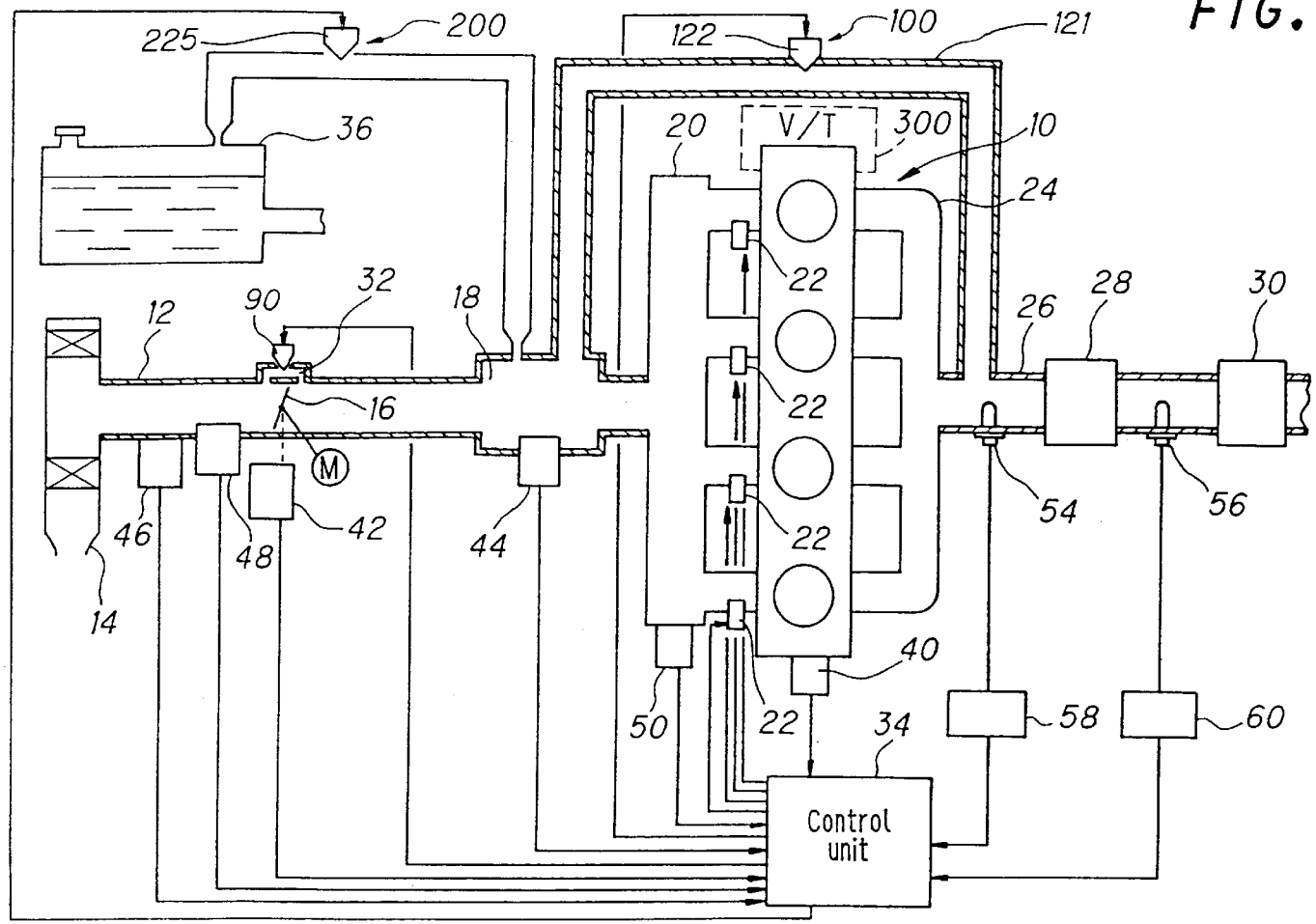
FIG. 1 is an overall schematic view showing an air/fuel ratio control system of an internal combustion engine according to the present invention.

FIG. 1 is an overall schematic view of an air/fuel ratio control for an internal combustion engine according to the invention.

Reference numeral 10 in this figure designates an overhead cam (OHC) in-line four-cylinder (multi-cylinder) internal combustion engine. Air drawn into an air intake passage 12, through an air cleaner 14 mounted on a far end thereof, is supplied to each of the first to fourth cylinders through a surge tank 18, an intake manifold 20 and two intake valves (not shown), while the flow of the air is adjusted by a throttle valve 16. A fuel injector (fuel injection means) 22 is installed in the vicinity of the intake valves of each cylinder and is for injecting or supplying fuel into the cylinder. The injected fuel mixes with the intake air to form an air-fuel mixture that is ignited in the associated cylinder by a spark plug (not shown) in the firing order of #1, #3, #4 and #2 cylinder. The resulting combustion of the air-fuel mixture drives a piston (not shown) down.

The exhaust gas produced by the combustion is discharged through two exhaust valves (not shown) into an exhaust manifold 24, from where it passes through an exhaust pipe 26 to a first catalyst (three-way catalytic converter) 28 and a second catalyst (also a three-way catalytic converter) 30 where noxious components are removed therefrom before it is discharged to the exterior. Although not mechanically linked with an accelerator pedal (not shown), the throttle valve 16 is controlled to a desired degree of opening by a stepping motor M. In addition, the throttle valve 16 is bypassed by a bypass 32 provided at the air intake pipe 12 in the vicinity thereof.

The engine 10 is equipped with an exhaust gas recirculation (EGR) mechanism 100 that includes an exhaust gas recirculation pipe 121 for recirculating the exhaust gas into the air intake system, and a canister purge mechanism 200 that allows vaporized fuel to flow to the air intake system from a fuel tank 36. Since, however, the gist of the invention does not reside in these mechanisms, no further explanation is given.

The engine is also equipped with a variable valve timing mechanism 300 (illustrated as V/T in the figure). As described in Japanese Laid-Open Patent Application No. Hei 2 (1990)-275043, for example, the variable valve timing mechanism 300 switches the opening/closing timing and the lift amount of the intake and/or exhaust valves between two types of timing characteristics, a characteristic for low engine speed LoV/T and another characteristic for high engine speed HiV/T in response to the engine speed and the manifold pressure. Since the operation of this mechanism is well-known, however, it will not be further described here. Among the different ways of switching between the two characteristics is to deactivate one of the two intake valves.

The engine 10 of FIG. 1 is provided in its ignition distributor (not shown) with a crank angle sensor 40 which generates a) a cylinder identification signal at a specific crank angle of a certain cylinder among the four cylinders, b) a reference crank angle signal at a predetermined crank angle of each cylinder, and c) a unit crank angle signal once per unit crank angle such as at 15 crank angle degrees. The engine 10 is further provided with a throttle position sensor 42 which generates a signal indicative of the degree of opening of the throttle valve 16, and an absolute manifold pressure sensor 44 which generates a signal indicative of the pressure, in terms of absolute pressure, in the intake passage or manifold downstream of the throttle valve 16.

In addition, the engine 10 is provided, at appropriate locations, with an atmospheric pressure sensor 46 which generates a signal indicative of atmospheric pressure of the location where the engine is situated, an intake air temperature sensor 48 which generates a signal indicative of the temperature of the intake air, an engine coolant temperature sensor 50 which generates a signal indicative of the temperature of the engine coolant, and a valve timing (V/T) sensor 52 (not shown in FIG. 1) which generates a signal indicative of which timing characteristic is selected by the variable valve timing mechanism 300 based on the oil pressure in the oil pressure circuit of the mechanism 300.

Moreover, the aforesaid wide-range air/fuel ratio sensor 54 is provided at the confluence or collection point of the engine exhaust downstream of the exhaust manifold 24 and upstream of the first catalyst 28, where it generates a signal indicative of the oxygen concentration in the exhaust gas at the confluence point. An $O_2$ sensor 56 is provided at a location downstream of the sensor 54 and the first catalyst 28 and generates a signal indicative of the oxygen concentration. The first catalyst 28 has the volume of approximately 1 liter or thereabout and the second catalytic converter has a volume of approximately 1.7 liter. The first and second catalysts may be configured to be a first bed and a second bed housed in a single unit and sandwiching the $O_2$ sensor 56 therebetween.

The air/fuel ratio sensor 54 is followed by a filter 58, while the $O_2$ sensor 56 is followed by a filter 60. The outputs of the sensors and filters are sent to a control unit 34.

Figure 2:
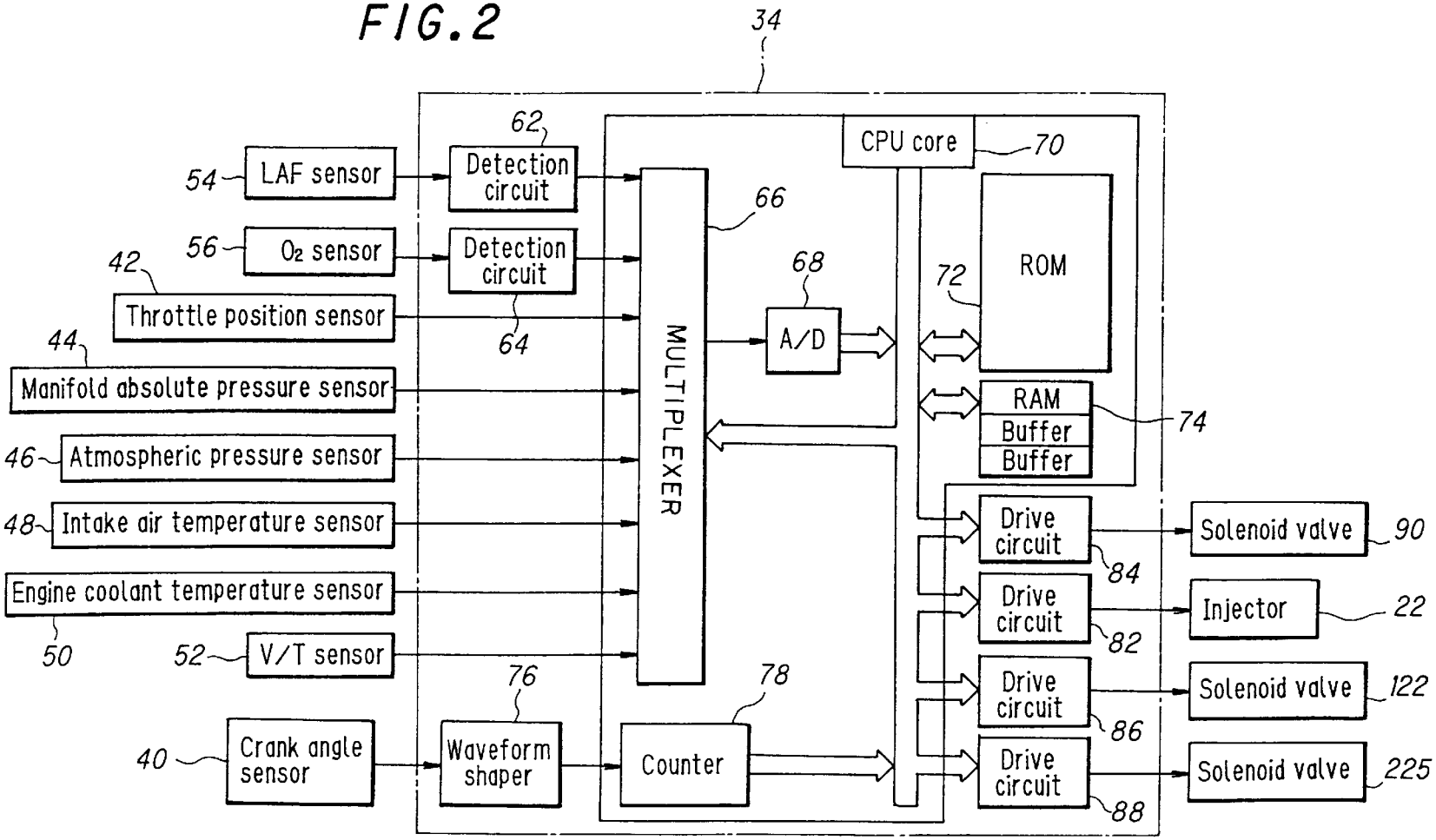
FIG. 2 is a block diagram showing the details of a control unit illustrated in FIG. 1.
Figure 3:
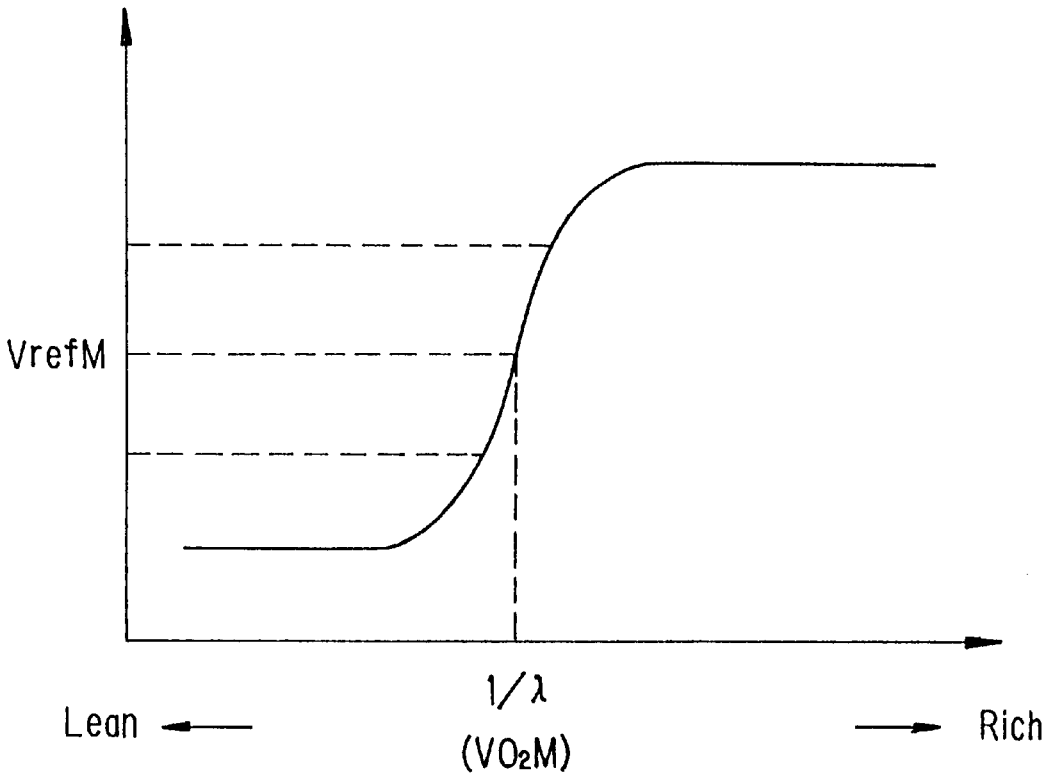
FIG. 3 is a graph showing the output characteristic of an $O_2$ sensor illustrated in FIG. 1.

Details of the control unit 34 are shown in the block diagram of FIG. 2. The output of the air/fuel ratio sensor 54 is input to a first detection circuit 62 where it is subjected to appropriate linearization processing for producing an output that varies linearly with the oxygen concentration of the exhaust gas over a wide range extending from lean to rich. (The sensor is denoted as "LAF sensor" in the figure and will be so referred to in the remainder of the description). The output of the $O_2$ sensor 56 is input to a second detection circuit 64 which produces a signal indicating that the oxygen concentration is richer or leaner than the stoichiometric air/fuel ratio, as shown in FIG. 3.

The output of the first detection circuit 62 is forwarded through a multiplexer 66 and an A/D converter 68 to a microcomputer. The microcomputer has a CPU core 70, a ROM (read-on-memory) 72 and a RAM (random access memory) 74. The output of the first detection circuit 62 is A/D converted once every prescribed crank angle (e.g., 15 degrees) and stored successively in buffers of the RAM 74. Similarly, the output of the second detection circuit 64 and other analog outputs of the throttle position sensor 42, etc., are input to the microcomputer through the multiplexer 66 and the A/D converter 68 and are stored in the RAM 74.

The outputs of the crank angle sensor 40 are shaped by a waveform shaper 76 and are then input to the microcomputer via counter 78 where the unit crank angle signals are counted to determine the engine speed Ne. In the microcomputer, the CPU core 70 calculates the amount of fuel to be supplied to the engine (fuel injection amount) in the manner described later in accordance with instructions stored in the ROM 72 and drives one among the fuel injectors 22 concerned via a drive circuit 82. The CPU core 70 calculates various manipulated variables a) for a solenoid valve (EACV) 90 for opening and closing the bypass 32 which regulates the amount of secondary air to be supplied to the engine, b) for the solenoid valve 122 which regulates the amount of exhaust gas recirculation and c) for the solenoid valve 225 which regulates the amount of canister purge, and drives the valves through drive circuits 84, 86, 88.

Figure 4:
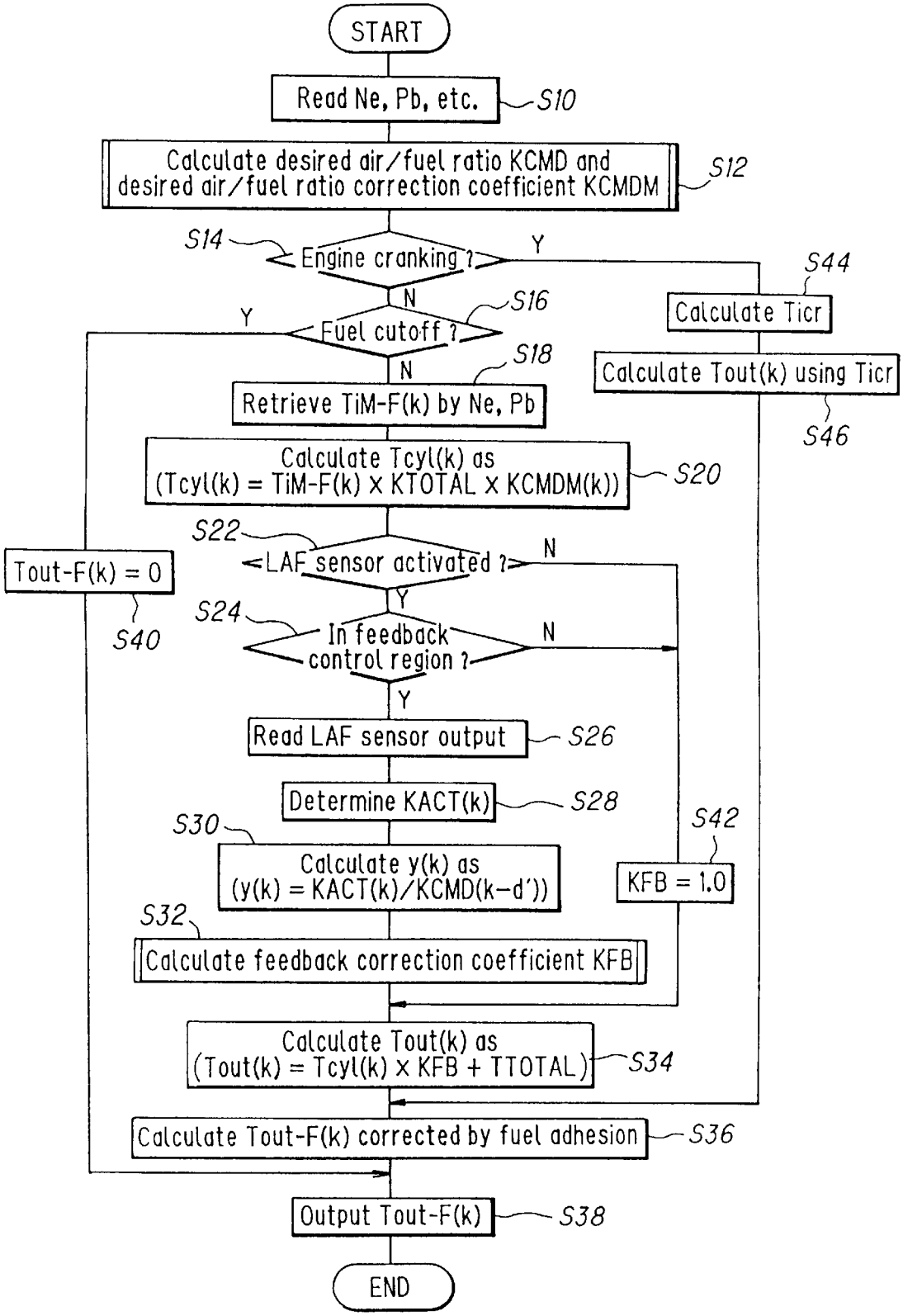
FIG. 4 is a flow chart showing the operation of the system illustrated in FIG. 1.

FIG. 4 is a flow chart showing the operation of the air/fuel ratio control system according to the present invention.

Figure 5:
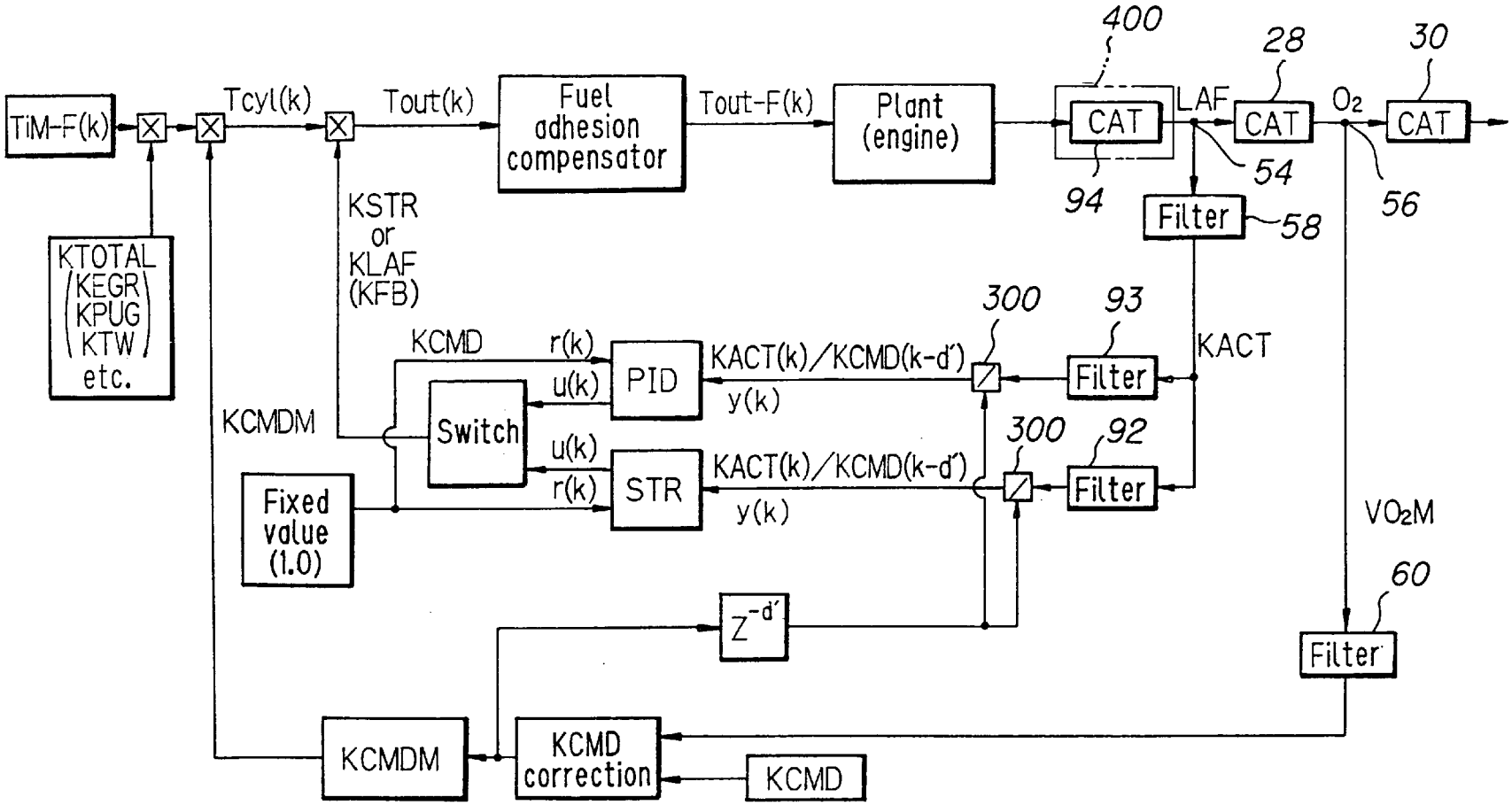
FIG. 5 is a block diagram similarly showing the operation of the system functionally.
Figure 6:
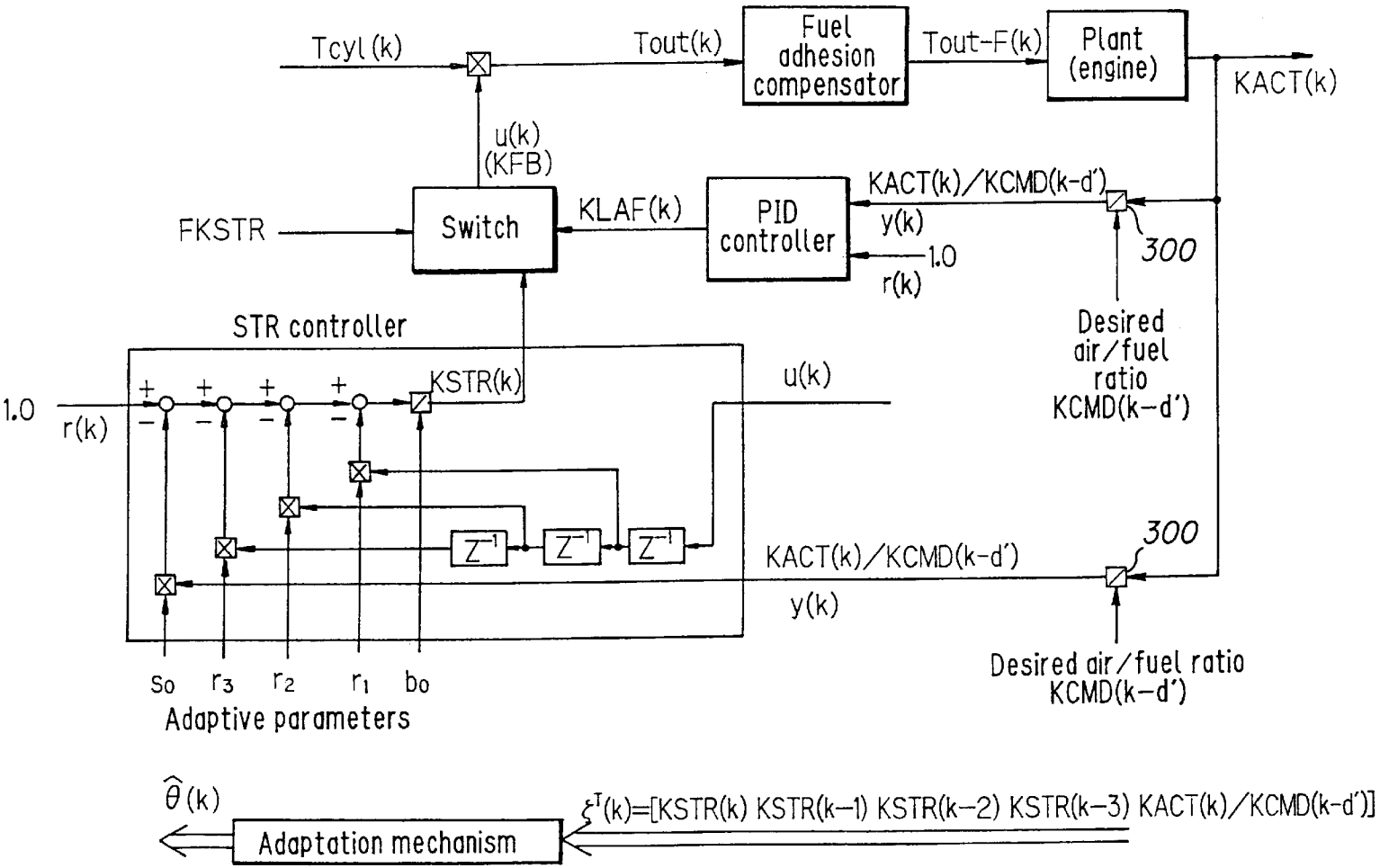
FIG. 6 is a block diagram showing the configuration of an adaptive controller illustrated as a "STR controller" in FIG. 5.

However, prior to explaining the flow chart, the operation of the air/fuel ratio control system will first be explained with reference to FIG. 5 and FIG. 6. FIG. 5 is a block diagram of the air/fuel ratio control system and FIG. 6 is a similar view which is a redrawn configuration illustrated in FIG. 5 focusing on the adaptive controller (STR controller; denoted as "STR" in FIG. 5) and the adaptation mechanism.

As illustrated in FIG. 5, the system is provided with the adaptive controller configured as a self-tuning regulator "STR" that receives the output of the LAF sensor 54 through the filters 58 and 92. The output of the $O_2$ sensor 56, shown as "$VO_2M$", is input to a desired air/fuel ratio correction block (shown as "KCMD correction" in the figure) where the desired air/fuel ratio KCMD is input and is corrected based on an error between the $O_2$ sensor output "$VO_2M$" and its desired value "VrefM" (shown in FIG. 3, but is omitted in FIG. 5) and a desired air/fuel ratio correction coefficient KCMD (explained later) is then obtained.

On the other hand, a basic amount of fuel supply (basic fuel injection amount) TiM-F(k) is determined or calculated by retrieving mapped data (whose characteristic is not shown) using appropriate engine parameters such as the engine speed and engine load and is multiplied by the desired air/fuel ratio correction coefficient KCMD and a correction coefficient KTOTAL (the product of other correction coefficients including those for EGR correction and canister purge correction). In the figure, the "x" is used, instead of an addition sign, to mean multiplication. The amount of fuel supply, thus corrected by multiplication, is Tcyl(k) which indicates an amount of fuel supply required by the engine. Such a determination of fuel supply amount through the mapped data retrieval can be referred to as "calculating the amount of fuel supply in a feedforward system".

As will be explained later, the adaptive controller STR and a PID (proportion, integral and derivative) controller shown as "PID" in the figure calculate feedback correction coefficients named as "KSTR" and "KLAF" (generally named as "KFB") on the basis of the detected air/fuel ratio KACT(k) and the desired air/fuel ratio KCMD(k–d') in accordance with the adaptive control law or the PID control law. Either of the feedback correction coefficients is selected through a switch (shown as "Switch") in response to the operating condition of the engine 10. The required amount of fuel supply Tcyl is then multiplied by the selected coefficient to determine an output amount of fuel supply named Tout. The output amount of fuel supply is then subject to fuel adhesion correction for compensating the amount of fuel adhering to the intake manifold and the corrected amount of fuel supply named as "Tout-F" is finally supplied into any of the cylinders of the engine 10.

Thus, the air/fuel ratio is controlled to the desired air/fuel ratio on the basis of the output of the LAF sensor 54 in a feedback manner. A fine air/fuel ratio control (referred to below as "$MIDO_2$" control) is carried out within the range of the catalyst window. In order to enhance the catalyst purification efficiency in the $MIDO_2$ control, it is necessary to converge the air/fuel ratio supplied to the catalyst, to the desired air/fuel ratio in a time as short as possible after the $O_2$ sensor output has turned in the opposite direction (i.e., such as from rich to lean). However, if the amount of fuel supply is determined by retrieving the value TiM-F from the mapped data prepared in advance and is corrected only by only with the desired air/fuel ratio correction coefficient KCMDM, the desired air/fuel ratio would disadvantageously be a value equal to a smoothed detected air/fuel ratio KACT. In order to solve this problem, accordingly, the system is configured so that the amount of fuel supply is multiplied by the feedback correction coefficient KSTR which is generated by the adaptive controller STR which dynamically compensates the desired air/fuel ratio KCMD such that the detected air/fuel ratio KACT converges to the desired air/fuel ratio KCMD immediately, thereby improving the catalyst purification efficiency.

In order to explain the filters, the configuration illustrated is constituted as a multi-imposed feedback control system where a plurality of feedback loops are provided in parallel and all using in common the output of the single LAF sensor 54. Therefore, the frequency characteristics of the filters are determined in accordance with the manner of control. Specifically, the filter 58 is configured to be a low-pass filter whose cutout frequency is 500 Hz, the filter 92 is configured to be a low-pass filter having the cutout frequency of 4 Hz, the filter 93 should be a similar filter having a cutout frequency equal to or greater than that of the filter 92. The filter 60 connected to the $O_2$ sensor is a low-pass filter having the cutout frequency of 1600 Hz or thereabout.

The operation of the system will now be explained with reference to the flow chart shown in FIG. 4.

The program starts at S10 in which the engine parameters indicative of the operating condition of the engine such as engine speed Ne and the absolute manifold pressure Pb are read. The program then goes to S12 in which the desired air/fuel ratio KCMD and the desired air/fuel ratio correction coefficient KCMDM are calculated.

Figure 7:
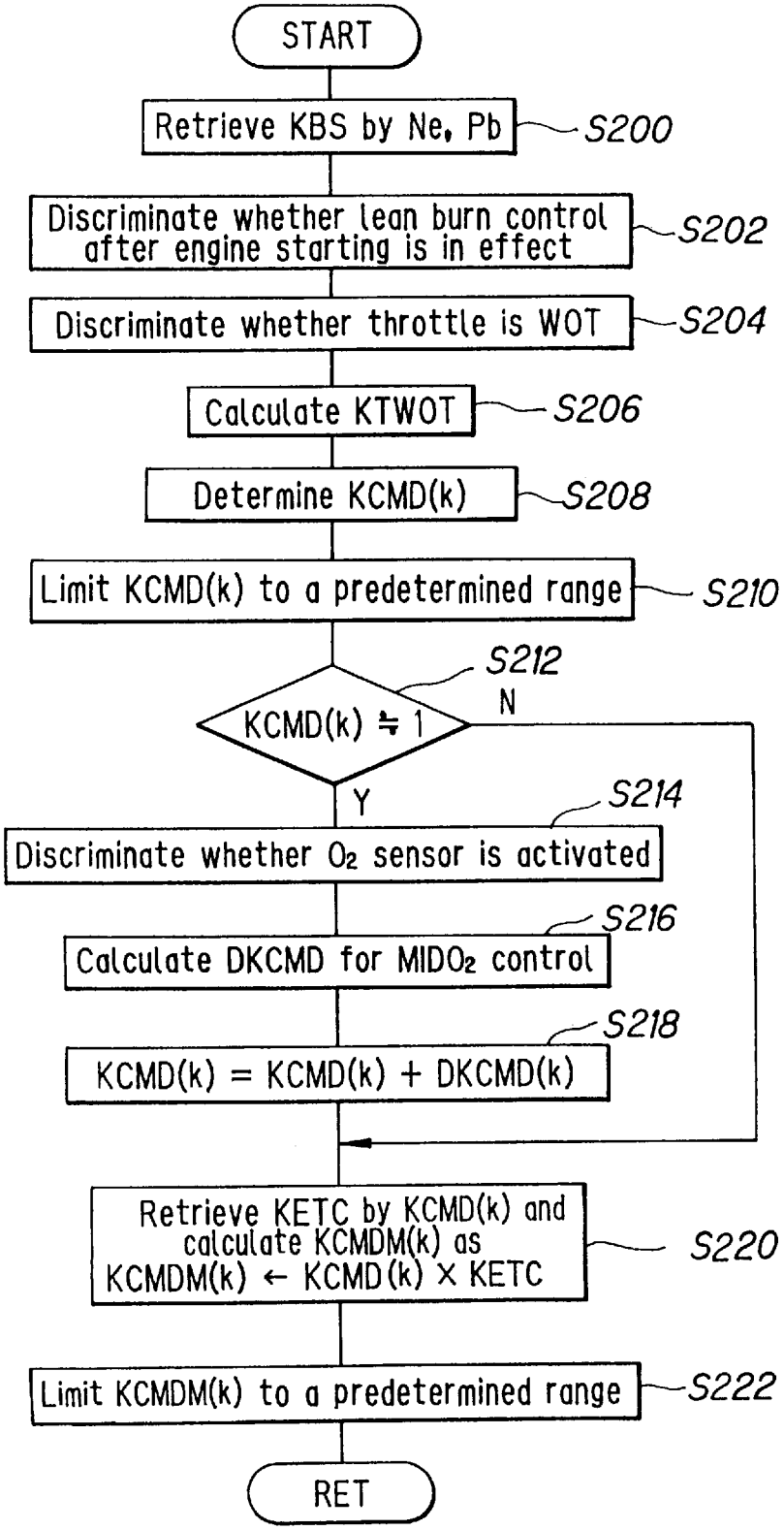
FIG. 7 is a flow chart showing the subroutine of the calculation of a desired air/fuel ratio KCMD and a desired air/fuel ratio correction coefficient KCMD referred to in the flow chart of FIG. 4.

FIG. 7 is a flow chart showing the subroutine for calculating KCMD and KCMDM.

Figure 8:
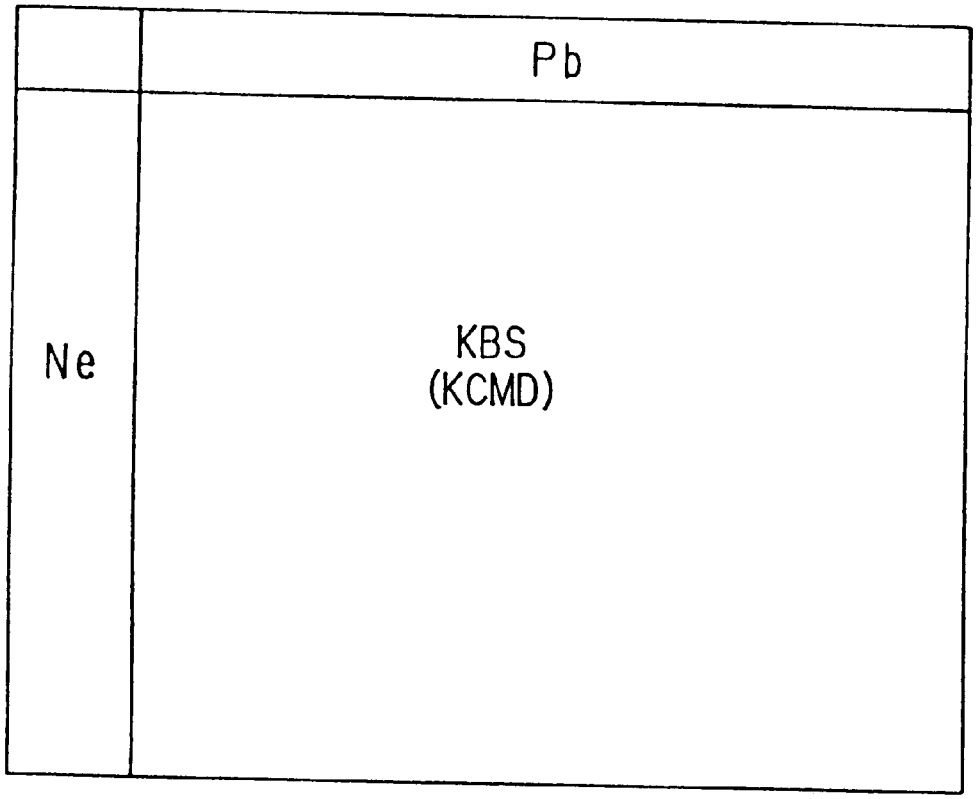
FIG. 8 is a graph showing the characteristic of a basic value KBS of the desired air/fuel ratio KCMD referred to in the flow chart of FIG. 7 and prepared beforehand as mapped data.

The program begins at S200 in which a basic value named KBS of the desired air/fuel ratio KCMD is retrieved from mapped data (whose characteristic is illustrated in FIG. 8) using the engine speed Ne and the absolute manifold pressure Pb as address data. Similar mapped data are prepared for engine idling or for a lean burning control, although neither of the characteristics is illustrated.

The program then proceeds to S202 in which it is determined, by referring to a timer value, whether a lean burning control after engine starting is in progress. The variable timing mechanism 300 in the system allows one intake valve to rest for a predetermined period of time after starting the engine to effect the lean burning control in which the air/fuel ratio is set to be leaner than the stoichiometric value such that a richer air-fuel mixture is supplied for the period during which the catalyst has not been activated. Thus, the emission of HC is prevented from being increased. From this reason, a timer value is used to determine whether it is within the period of time for lean burning control and based on the result of the determination, a lean burn correction coefficient is determined such as 0.89 when it is within the period and 1.0 when it is not.

The program then proceeds to S204 in which it is determined whether the throttle valve 16 is fully opened (wide-open throttle) and based on the result, a full-throttle enrichment correction coefficient is calculated. The program then goes to S206 in which it is determined whether the engine coolant temperature TW is higher than a reference value and based on the result, an augmentative correction coefficient KTWOT is calculated. The value KTWOT includes a correction coefficient for preventing the engine from being damaged by a high engine coolant temperature. The full-throttle enrichment correction coefficient and the value KTWOT are set to 1.1, for example, when enrichment is needed, while set to 1.0 when enrichment is not needed.

The program then advances to S208 in which the basic value KBS is multiplied by the correction coefficients just determined to obtain the desired air/fuel ratio KCMD(k). At the same time, a window value (referred to as DKCMD-OFFSET) for the fine air/fuel ratio control is set within a range in which the $O_2$ sensor output has a linear characteristic in the proximity of the stoichiometric air/fuel ratio as illustrated by the broken lines in FIG. 3. The value DKCMD-OFFSET is then added to the basic value KBS. More precisely, the desired air/fuel ratio KCMD(k) is determined as follows.

$$KCMD(k)=KBS(=\text{correction coefficients})+DKCMD\text{-}OFFSET$$

When the correction coefficients calculated in S204 and S206 are other than 1.0, the correction by the window value DKCMD-OFFSET may be omitted, since the engine is controlled to a rich air/fuel ratio.

The program then goes to S210 in which the desired air/fuel ratio KCMD(k) is limited within a predetermined range if it exceeds an upper limit or a lower limit. At S212, a determination is made whether the desired air/fuel ratio KCMD(k) is 1.0 or thereabout. When the result is affirmative, the program goes to S214 in which it is determined whether the $O_2$ sensor 56 has been activated. This is conducted in a subroutine (not shown) by detecting the rate of change of the $O_2$ sensor output voltage $VO_2M$. The program then proceeds to S216 in which a value DKCMD for the $MIDO_2$ control is calculated. The purpose of this processing is to correct the desired air/fuel ratio KCMD(k) to be supplied from the LAF sensor 54, located upstream of the first catalyst 28, on the basis of the output of the $O_2$ sensor 56 located downstream of the catalyst 28. More specifically, this is done by comparing a predetermined reference voltage VrefM (illustrated in FIG. 3) and the $O_2$ sensor output voltage $VO_2M$ to calculate an error therebetween and by calculating the value DKCMD based on this error using a PID control law. The reference voltage VrefM is determined on the basis of the atmospheric pressure Pa, the engine coolant temperature TW, the volume of exhaust gas (that can be estimated from the engine speed Ne and the absolute manifold pressure Pb) and some similar engine parameters.

The aforesaid window value DKCMD-OFFSET is an offset value so that the first and second catalysts 28, 30 achieve the maximum purification efficiency. Since the offset value is different from each other by the property or characteristic of a catalyst, the value should be determined taking the property or characteristic of the first catalyst 28 into account. In addition, since the value varies with the aging of the catalyst, the value is calculated in a learning control manner by averaging the calculated values using a weight W as follows;

$$DKCMD\text{-}OFFSET(k)=W\times DKCMD+(1-W)\times DKCMD\text{-}OFFSET(k-1).$$

With this arrangement, the air/fuel ratio is feedback-controlled to the desired air/fuel ratio such that the catalyst purification efficiency becomes a maximum, without being influenced by the aging of the catalyst. The learning control may be carried out separately in engine operating regions defined by the engine operating conditions such as the engine speed Ne and the manifold absolute pressure Pb.

Figure 9:
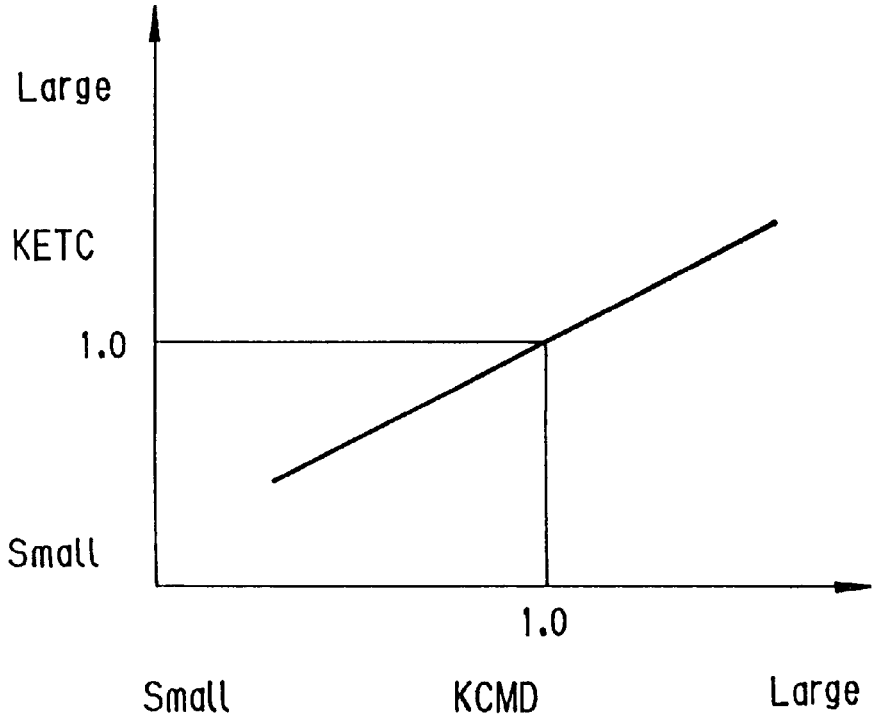
FIG. 9 is a graph showing the characteristic of a correction coefficient KETC for adjusting the charging efficiency of the intake air referred to in the flow chart of FIG. 7.

The program next goes to S218 in which the calculated value DKCMD(k) is added to the desired air/fuel ratio KCMD(k) to update the desired air/fuel ratio. At S220, the desired air/fuel ratio feedback correction coefficient KCMD (k) is calculated by multiplying the desired air/fuel ratio by a correction coefficient KETC. This is done, more specifically, by retrieving the correction coefficient KETC from a table (whose characteristic is shown in FIG. 9) using the desired air/fuel ratio KCMD(k) as address data. Since the charging efficiency of intake air varies with evaporation heat, this correction aims to compensate for charging efficiency. The desired air/fuel ratio feedback correction coefficient KCMDM(k) is thus obtained by adjusting the desired air/fuel ratio by the charging efficiency correction.

On the other hand, when the result of determination in S212 is negative, since this means that the desired air/fuel ratio deviates greatly from the stoichiometric air/fuel ratio such as under lean burning control and since no $MIDO_2$ control is needed, the program jumps to S220.

The program then goes to S222 in which the desired air/fuel ratio correction coefficient KCMDM(k) is similarly limited within a predetermined range if it exceeds an upper limit or a lower limit.

Returning to the flow chart of FIG. 4, the program proceeds to S14 in which it is checked whether the engine is cranking and if it is not, proceeds to S16 in which it is checked whether the supply of fuel is cut off. Fuel cutoff is implemented under a specific engine operating condition such as when the throttle valve 16 is fully closed and the engine speed is higher than a prescribed speed. The supply of fuel is stopped under the condition and the air/fuel ratio is controlled in an open-loop fashion.

When S16 determines that the fuel cutoff is not in progress, the program proceeds to S18 in which the basic amount of fuel supply TiM-F is calculated by retrieving the mapped data using the detected engine speed Ne and the manifold absolute pressure Pb as address data as mentioned earlier. It should be noted that, as the assignee proposed in Japanese Laid-Open Patent Application No. Hei 8 (1996)-42800, the value obtained by map retrieval may be multiplied by a ratio determined from the effective opening area of the throttle valve 16 so as to accurately determine the amount of fuel supply that would correspond to the amount of intake air passing through the throttle valve 16 as follows;

TiM-F=map retrieval value×(actual effective throttle opening area/effective throttle opening area obtained based on manifold absolute pressure Pa and throttle opening's first-order lag value θTH-D)

The program then goes to S20 in which the basic amount of fuel supply TiM-F is multiplied by the general correction coefficient KTOTAL and the desired air/fuel ratio correction coefficient KCMDM(k) to determine the required amount of fuel supply Tcyl(k). At S22 the LAF sensor 54 is checked to determine if it has been activated. This is done in a manner similar to that explained with reference to S214 in FIG. 7, by calculating a difference between the sensor output voltage and its centered value to compare the difference with a prescribed value (0.4 V, for example). If the difference is smaller than the prescribed value, it is determined that the LAF sensor activation has been completed.

When S22 determines that the LAF sensor has been activated, the program goes to S24 in which it is determined that the engine operation is within a feedback control region. This is conducted in a subroutine (not shown). When the engine is subject to the full-load enrichment, when the engine runs at a high speed, or when the engine operation has sharply changed due to, for example, the initiation of the exhaust gas recirculation, the air/fuel ratio control is implemented in the open-loop manner.

When the result in S24 is affirmative, the program proceeds to S26 in which the LAF sensor output is read. Then, at S28, the detected air/fuel ratio KACT(k) is determined. At S30, a ratio between the detected air/fuel ratio KACT(k) and the desired air/fuel ratio KCMD(k–d') is calculated. The ratio is used as the controlled variable y(k) to be input to the adaptive controller (and the PID controller explained later). It should be noted here that the controlled variable is usually used to mean a value output from the plant and immediately input to the controller. However, the controlled value in this specification is used to mean a value input to the controller, since the value is not solely made up of the plant output.

To easily understand the processing in S30, the adaptive controller (STR controller) will here be explained referring to FIG. 6.

As illustrated, the adaptive controller comprises, more precisely, the STR (self-tuning regulator) controller and the adaptation mechanism that estimates/ identifies the adaptive parameters (some times called as "controller parameters" or "system parameters") $\hat{\theta}$ expressed in a vector (coefficient vector; where "^" means estimated values). Based on the adaptive parameters $\hat{\theta}$, the STR controller operates to calculate the feedback correction coefficient KSTR(k) using a recurrence formula, as illustrated. The STR controller receives the adaptive parameters and calculates the correction coefficient such that the controlled variable becomes equal to the desired value, thus acting as a feedback compensator.

One estimation (identification) or adaptation law (algorithm) available for adaptive control is that proposed by I. D. Landau et al. In the adaptation law proposed by I. D. Landau et al., the adaptive control system is transformed to an equivalent feedback control system comprised of a linear block and a non-linear block. The estimation law is determined to ensure system stability such that the non-linear block satisfies Popov's integral inequalities on the input and output and the linear block is a perfect positive real. In other words, the stability of the adaptation law expressed in a recursion or recurrence formula is ensured at least using Lyapunov's theory or Popov's hyperstability theory.

This method is described in, for example, *Computrol* (Corona Publishing Co., Ltd.) No. 27, pp. 28–41; *Automatic*

*Control Handbook* (Ohm Publishing Co., Ltd.) pp. 703–707; "A survey of Model Reference Adaptive Techniques-Theory and Applications" by I. D. Landau in Automatica, vol. 10, pp. 353–379, 1974; "Unification of Discrete Time Explicit Model Reference Adaptive Control Designs" by I. D. Landau et al., in Automatica, vol. 17, No. 4, pp. 593–691, 1981; and "Combining Model Reference Adaptive Controllers and Stochastic Self-tuning Regulators" by I. D. Landau in Automatica, Vol. 18, No. 1, pp. 77–84, 1982.

In the adaptive controller illustrated in FIG. 6, the adaptation (or identification) algorithm of I. D. Landau et., is used. In the algorithm, when the polynomial of the denominator and numerator of the transfer function B(Z−1)/A(Z−1) of the controlled object in discrete-time series is defined as Eqs. 1 and 2 below, the adaptive parameters $\hat{\theta}(k)$ estimated or identified by the adaptation mechanism are shown as Eq. 3 in a vector (transpose vector). Intermediate value $\zeta(k)$ input to the adaptation mechanism is shown as Eq. 4. Here, there is taken as an example a plant in which m=1, n=1 and d=3, i.e., the plant model is given in the form of a linear system with 3 control cycles of dead time.

$$A(Z^{-1}) = 1 + a_1 z^{-1} + \ldots + a_n z^{-n} \quad \text{Eq. 1}$$

$$B(Z^{-1}) = b_0 + b_1 z^{-1} + \ldots + b_m z^{-m} \quad \text{Eq. 2}$$

$$\begin{aligned}\hat{\theta}^T(k) &= \left[\hat{b}_0(k), \hat{B}_R(z^{-1}, k), \hat{S}(z^{-1}, k)\right] \quad \text{Eq. 3}\\ &= \left[\hat{b}_0(k), \hat{r1}(k), \ldots, r_{m+d-1}(k), s_0(k), \ldots, s_{n-1}(k)\right]\\ &= [b_0(k), r_1(k), r_2(k), r_3(k), s_0(k)]\end{aligned}$$

$$\begin{aligned}\varsigma^T(k) &= [u(k), \ldots, u(k-m-d+1), y(k), \ldots, y(k-n+1)] \quad \text{Eq. 4}\\ &= [u(k), u(k-1), u(k-2), u(k-3), y(k)]\end{aligned}$$

In the above, the adaptive parameters $\hat{\theta}$ comprises the elements of a scalar quantity $\hat{b}_0^{-1}(k)$ that determines the gain, an element $\hat{B}_R(Z^{-1}, k)$ that is expressed by the manipulated variable and an element $\hat{S}(Z^{-1}, k)$. The elements are expressed as Eqs. 5 to 7 below.

$$\hat{b}_0^{-1}(k) = 1/b_0 \quad \text{Eq. 5}$$

$$\begin{aligned}\hat{B}_R(Z^{-1}, k) &= r_1 z^{-1} + r_2 z^{-2} + \ldots + r_{m+d-1} z^{-(m+d-1)} \quad \text{Eq. 6}\\ &= r_1 z^{-1} + r_2 z^{-2} + r_3 z^{-3}\end{aligned}$$

$$\begin{aligned}\hat{S}(Z^{-1}, k) &= s_0 + s_1 z^{-1} \ldots + s_{n-1} z^{-(n-1)} \quad \text{Eq. 7}\\ &= s_0\end{aligned}$$

The adaptation mechanism estimates or identifies these elements and sends as the adaptive parameters $\hat{\theta}$ (shown in Eq. 3) to the STR controller. Specifically, the adaptation mechanism calculates the adaptive parameters $\hat{\theta}$ using the manipulated variable u(i) input to the controlled object (plant) and the controlled variable y(j) output from the controlled object such that the error between the desired value and the controlled variable becomes zero. (Here, i, j include past values). Specifically, the adaptive parameters $\hat{\theta}$ are calculated in accordance with an equation shown in Eq. 8 below.

$$\hat{\theta}(k) = \hat{\theta}(k-1) + \Gamma(k-1)\zeta(K-d)e^*(k) \quad \text{Eq. 8}$$

In Eq. 8, Γ(k) is a gain matrix that is (m+n+d)th order square matrix and determines the estimation/identification speed of the adaptive parameters $\hat{\theta}$, an e*(k) is an error signal indicative of the generalized estimation/identification error, i.e., an estimation error signal of the adaptive parameters. They are expressed in a recurrence formulas as shown in Eqs. 9 and 10.

$$\Gamma(k) = \frac{1}{\lambda 1(k)}\left[\Gamma(k-1) - \frac{\lambda 2(k)\Gamma(k-1)\varsigma(k-d)\varsigma^T(k-d)\Gamma(k-1)}{\lambda 1(k) + \lambda 2(k)\varsigma^T(k-d)\Gamma(k-1)\varsigma(k-d)}\right]$$

where $$0 < \lambda 1(k) \leqq 1, 0 < \lambda 2(k) < 2, \Gamma(0) > 0 \quad \text{Eq. 9}$$

$$e^*(k) = \frac{D(z^{-1})y(k) - \hat{\theta}^T(k-1)\varsigma(k-d)}{1 + \varsigma^T(k-d)\Gamma(k-1)\varsigma(k-d)} \quad \text{Eq. 10}$$

In the above, D(z−1) in Eq. 10 is a polynomial defined by the designer and is set to 1.0 in this embodiment.

One among gain algorithms is determined by selecting λ1(k), λ2(k) in Eq. 9. To be more specific, when λ1(k)=1 and λ2(k)=λ(0<λ<2) gives the gradually-decreasing gain algorithm (least-squares method when λ=1); λ1(k)=λ1(0<λ1<1) and λ2(k)=λ2 (0<λ2<λ) gives the variable-gain algorithm (weighted least-squares method when 2λ=1). Defining λ1(k)/λ2(k)=σ and expressing λ3(k) as Eq. 11, the constant-trace gain algorithm is obtained where λ1(k) is made equal to λ3.

$$\lambda 3(k) = 1 - \frac{\|\Gamma(k-1)\varsigma(k-d)\|^2}{\sigma + \varsigma^T(k-d)\Gamma(k-1)\varsigma(k-d)} \cdot \frac{1}{tr\Gamma(0)} \quad \text{Eq. 11}$$

In the above, trΓ(0) is a trace of the initial value of Γ. Moreover, if λ1(k)=1, λ2(k)=0, the constant-gain algorithm is obtained. In this case, as is clear from Eq. 9, Γ(k) becomes Γ(k−1), Γ(k) is fixed to Γ. All of the gain algorithm are effective in the time-varying plant including the air/fuel ratio control system according to the invention.

Thus, the adaptive controller describes the dynamic behavior of the controlled object (engine), specifically is a controller expressed in a recursion formula that compensates for the dynamic behavior of the controlled object, and more specifically is an adaptive controller having in its input an adaptation mechanism expressed in a recursion formula.

The feedback correction coefficient KSTR(k) is calculated in accordance with an equation shown in Eq. 12.

$$KSTR(k) = \frac{KCMD(k-d') - s_0 \times KSTR(k-1) - r_2 \times KSTR(k-2) - r_3 \times KSTR(k-3)}{b_0} \quad \text{Eq. 12}$$

Figure 14:
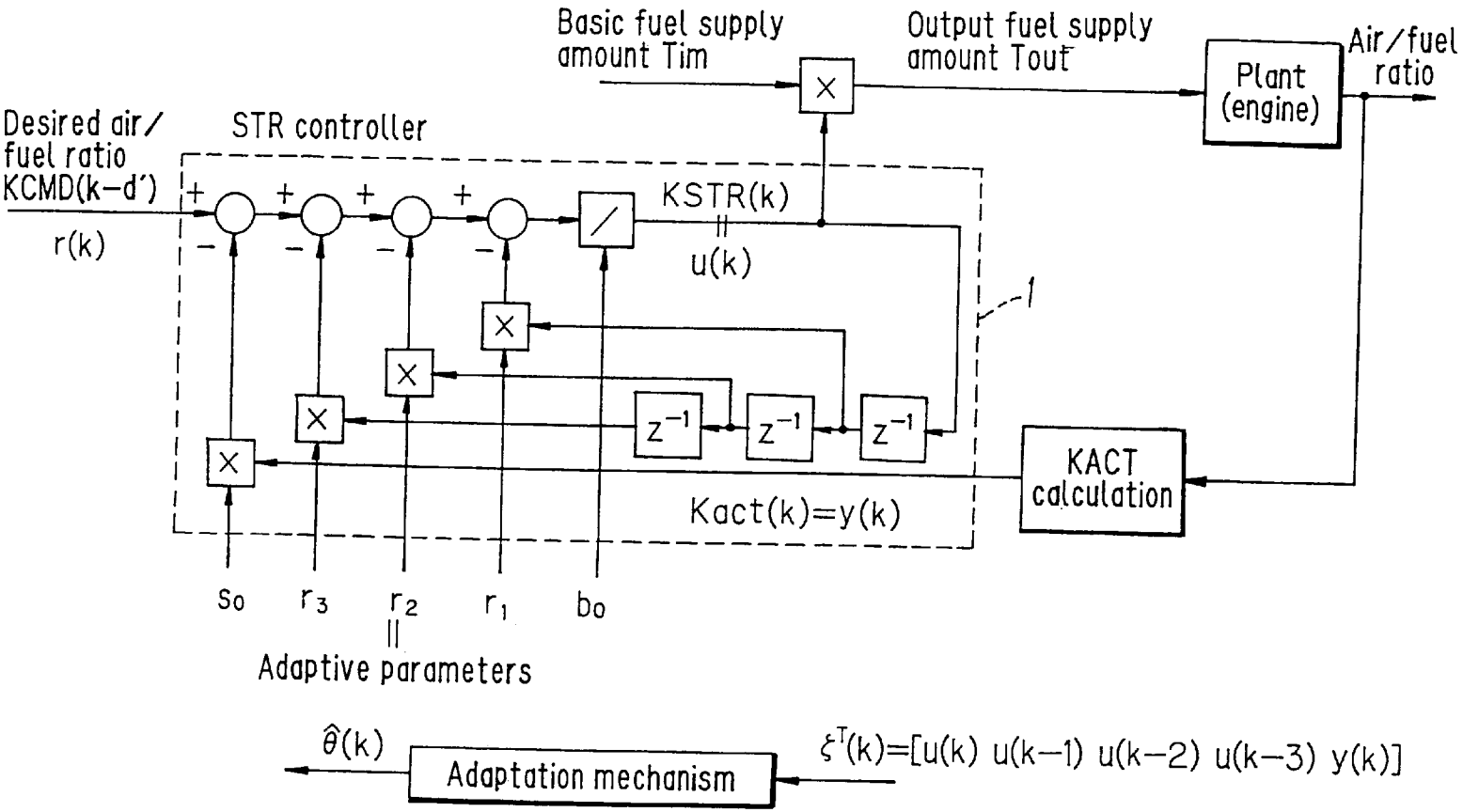
FIG. 14 PRIOR ART
FIG. 14 is a view, similar to FIG. 6, but showing the configuration of an adaptive controller in an air/fuel ratio control system previously proposed by the assignee.
Figure 15A:
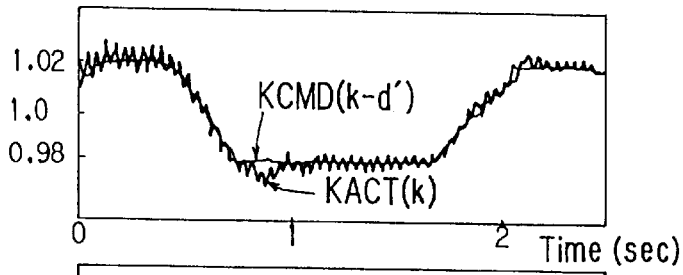
FIG. 15(a) PRIOR ART
FIG. 15 comprises of FIG. 15(*a*) to FIG. 15(*f*) which are views, similar to FIGS. 12(*a*) to (*f*), but showing simulation data conducted to verify the operation of the system illustrated in FIG. 14.
Figure 15B:
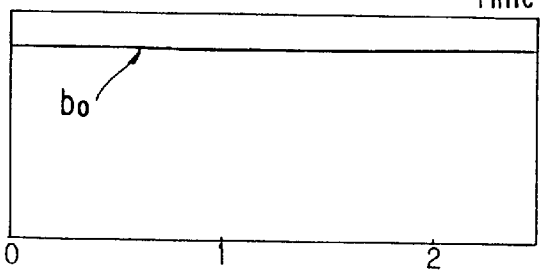
FIG. 15(b) PRIOR ART
Figure 15C:
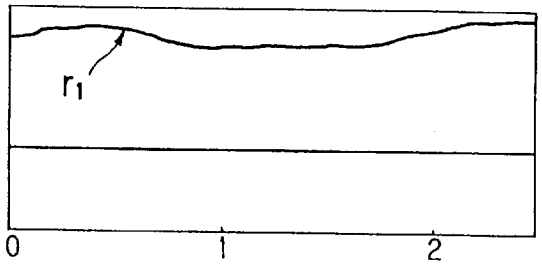
FIG. 15(c) PRIOR ART
Figure 15D:
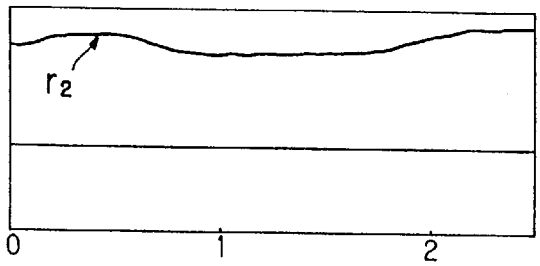
FIG. 15(d) PRIOR ART
Figure 15E:
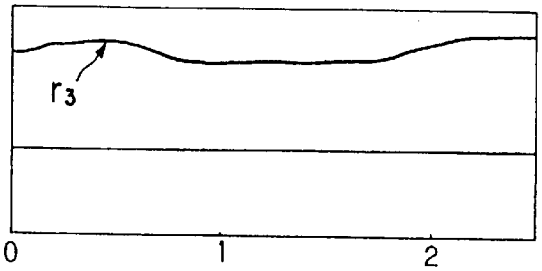
FIG. 15(e) PRIOR ART
Figure 15F:
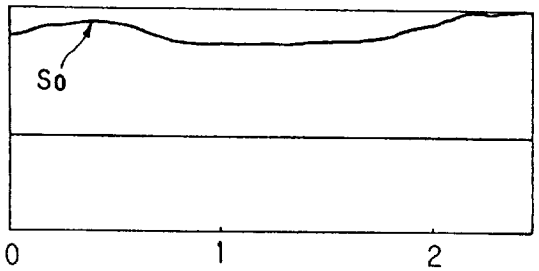
FIG. 15(f) PRIOR ART

In the arrangement illustrated in FIG. 14 and proposed by the assignee earlier, the desired air/fuel ratio KCMD is used as the desired value r of the STR controller and the STR controller operates, in cooperation with the adaptation mechanism, to calculate the feedback correction coefficient KSTR(k) such that the desired air/fuel ratio KCMD becomes equal to the detected air/fuel ratio KACT in the exhaust gas produced in the engine exhaust. As a result, as was explained with reference to FIG. 15, the configuration had a disadvantage in that when the desired air/fuel ratio is frequently changed, this acts as a disturbance to cause the adaptive parameters $\hat{\theta}$ to fluctuate.

In order to solve the problem, in the configuration according to the invention, as is illustrated in FIGS. 5 and 6, the detected air/fuel ratio KACT(k) is divided by the desired air/fuel ratio KCMD(k−d') at a node 300 (the "slash" in the node indicates division) to obtain the ratio KACT(k)/KCMD (k−d') between the detected air/fuel ratio KACT(k) and the desired air/fuel ratio (k−d') which is then input to the adaptive controller as an input (controlled variable) y(k). On the other hand, the desired value r of the adaptive controller is set to be a predetermined value, specifically a fixed value of 1.0. To be more specific, based on the detected air/fuel ratio KACT and the desired air/fuel ratio KCMD, the input y(k) of the adaptive controller is determined to be the predetermined value 1.0 (=KACT(k)/KCMD(k−d')), and the predetermined value 1.0 is determined to be the desired value r of the adaptive controller. It should be noted that when the configuration is thus altered, Eqs. 4 and 12 are rewritten as Eqs. 13 and 14.

$$\begin{aligned}\varsigma^T(k) &= [u(k), \ldots, u(k-m-d+1), y(k), \ldots, y(k-n+1)] \\ &= [u(k), u(k-1), u(k-2), u(k-3), \\ &\quad KACT(k)/KCMD(k-d')]\end{aligned} \quad \text{Eq. 13}$$

$$KSTR(k) = \frac{1.0 - s_0 \times y(k) - r_1 \times KSTR(k-1) - r_2 \times KSTR(k-2) - r_3 \times KSTR(k-3)}{b_0} \quad \text{Eq. 14}$$

Since the adaptive controller operates such that the desired value r and the controlled variable y become equal, i.e., 1.0=KACT/KCMD, if transformed, KCMD=KACT. The above will be the same if the controlled variable y determined as the detected air/fuel ratio KACT—the desired air/fuel ratio KCMD (or KCMD−KACT) and the desired value r is set to be 0, since 1=KACT−KCMD so that KACT=KCMD when transformed. Saying this generally, in the adaptive controlled shown in FIGS. 5 and 6, the controlled variable y and the desired value r are determined such that the desired air/fuel ratio and the detected air/fuel ratio becomes equal. It should be noted here that the desired value is strictly 1.0 or 0, but may be a value thereabout.

FIGS. 12(*a*) to 12(*f*) illustrate the result of a test conducted for the configuration shown in FIGS. 5 and 6 on an actual engine at the same conditions explained earlier with reference to FIG. 15. More precisely, the figures illustrate the response of the detected air/fuel ratio KACT(k) when the desired air/fuel ratio KCMD(k−d') was changed stepwise in the period of 2.5 seconds, while holding the engine parameters, i.e., the engine speed at 2800 rpm and the manifold pressure under −150 mm Hg (expressed as negative pressure).

As illustrated in FIG. 12(*a*), it has been verified that the detected air/fuel ratio KACT(k) faithfully followed the desired air/fuel ratio KCMD(k−d'), without overshooting. FIGS. 12(*b*) to (*f*) show the response of the elements of the adaptive parameters and as is clear from the figures, all the elements changed by a slight amount. Since the desired value r fluctuates very little, the adaptive parameters were stable.

With the above arrangement, it becomes possible to obtain a stable correction coefficient when calculating the coefficient using the adaptive parameters. The amount of fuel supply to be calculated using the correction coefficient will accordingly be stable. Thus, since the manipulated variable does not fluctuate, the air/fuel ratio control will be enhanced, causing no hunting to occur. Moreover, the fact that the values of the adaptive parameters are stable means that the calculation in the adaptation mechanism is stable. The robustness of the adaptive controller is thus improved.

In the system shown in FIGS. 5 and 6, in addition to the STR controller, the conventional PID (proportion, integral and derivative) controller is provided to calculate another feedback correction coefficient KLAF using the PID control law. Either of the correction coefficients KSTR and KLAF is selected or switched via the switch.

This is because, when the feedback correction coefficient is determined using a modern control theory such as the adaptive control law, since the control response is relatively high, the controlled variable may fluctuate or oscillate under some engine operating conditions, e.g., at the time of resuming fuel supply after it has been cut off, causing the control stability to lower. For that reason, the feedback correction coefficient is calculated using either the adaptive control law or PID control law and is switched in response to the operating condition of the engine. Since the different types of feedback correction coefficients have different characteristics, however, a sharp difference in level may arise between the coefficients. Switching between the coefficients is liable to destabilize the controlled variable stable and lower the stability of control. The system is therefore configured to make the switching smooth so as not to cause the control stability to be lower.

Returning to the explanation of FIG. 4, the program goes to S32 in which the feedback correction coefficient KFB (general name of the feedback correction coefficients KSTR and KLAF) is calculated.

Figure 10:
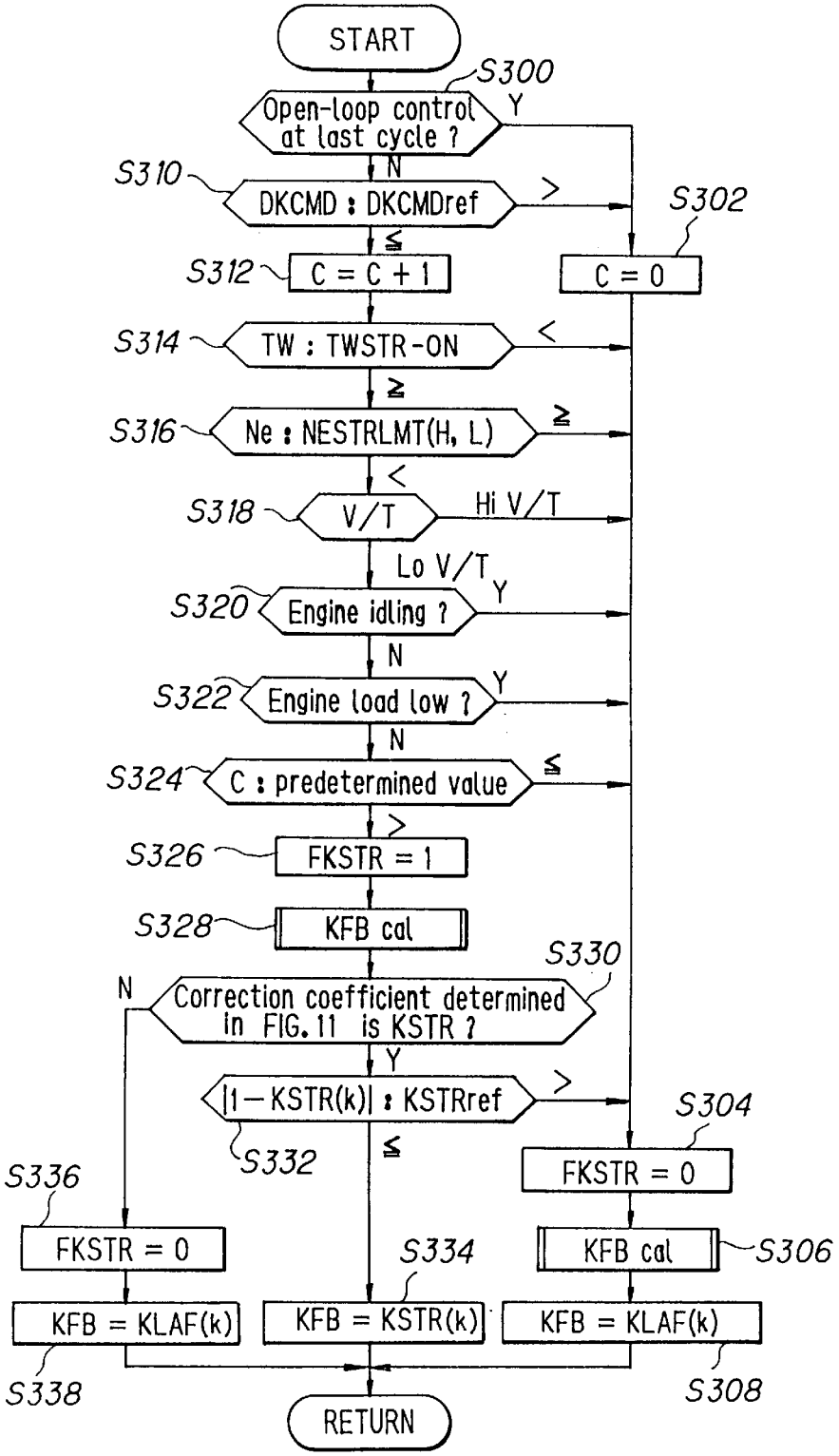
FIG. 10 is a flow chart showing the subroutine for the calculation of a feedback correction coefficient KFB referred to in the flow chart of FIG. 4.

FIG. 10 is a flow chart showing the subroutine for calculation of the KFB.

The program starts at S300 in which it is checked whether the air/fuel ratio was controlled in the open-loop fashion during the previous cycle (previous control or calculation cycle, more precisely at the preceding routine activation time). When the previous cycle was under an engine operation such as a fuel-cutoff in which the air/fuel ratio was controlled in the open-loop manner, the result is affirmative and the program proceeds to S302 in which a counter value C is reset or cleared to zero. At S304 the bit of a flag FKSTR is reset to zero. At S306 the feedback correction coefficient KFB is calculated. Here, resetting the bit of flag FKSTR to 0 in S304 indicates that the feedback correction coefficient is to be determined by the PID control law, while setting the bit of the flag FKSTR to 1 indicates that the engine operation is in the STR controller operation region so that the feedback correction coefficient is to be determined by the adaptive control law.

Figure 11:
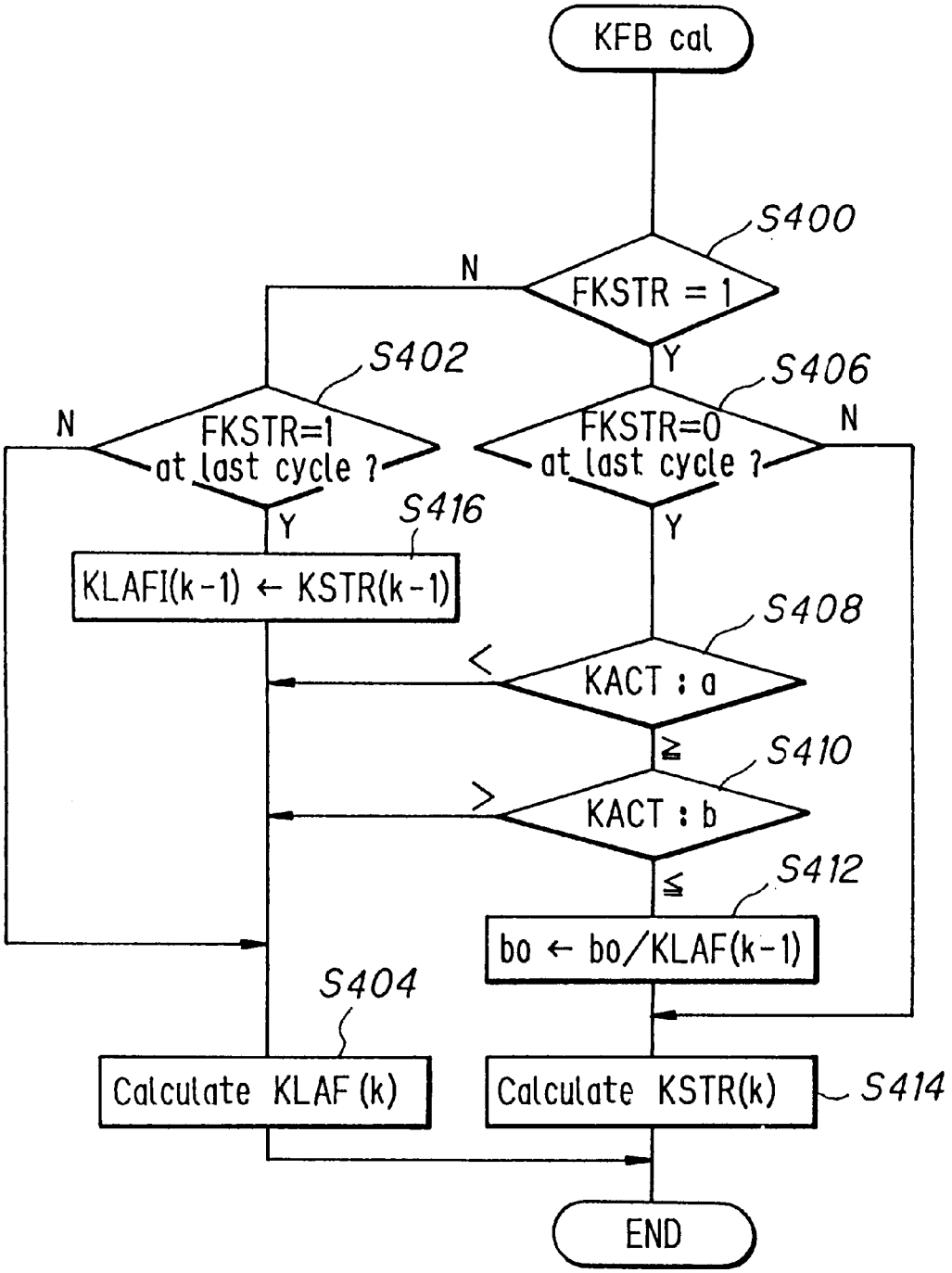
FIG. 11 is a flow chart showing the subroutine for the calculation of the coefficient KFB referred to in the flow chart of FIG. 10 more specifically.
Figure 12A:
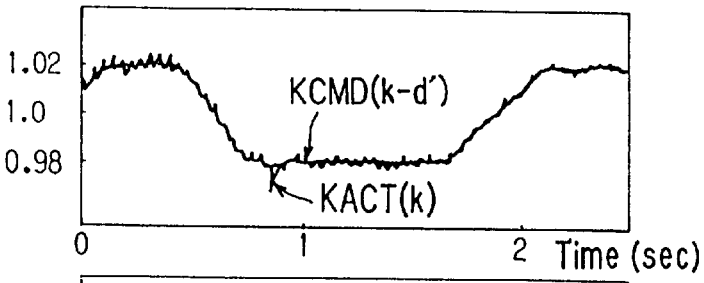
FIG. 12 comprises of FIG. 12(*a*) to FIG. 12(*f*) which are graphs showing simulation data conducted on an actual engine to verify the operation of the system according to the invention.
Figure 12B:
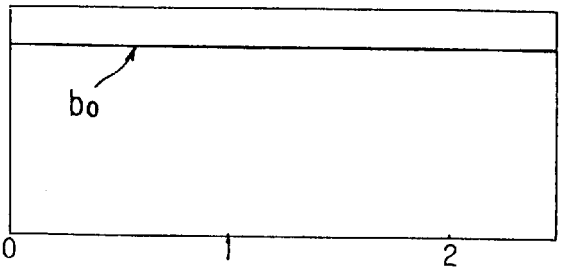
Figure 12C:
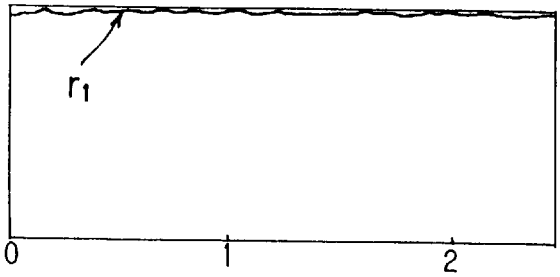
Figure 12D:
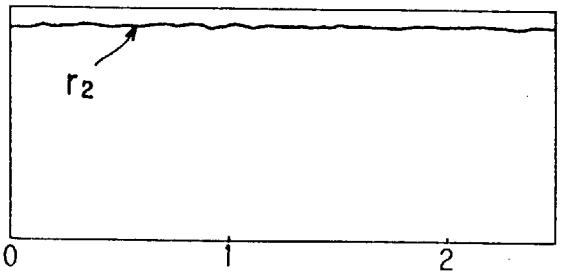
Figure 12E:
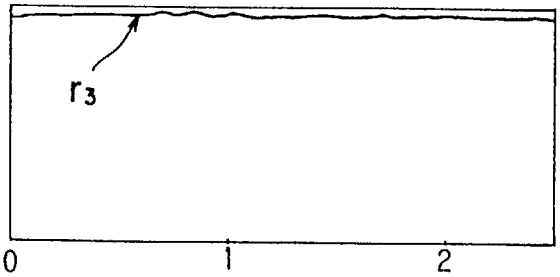
Figure 12F:
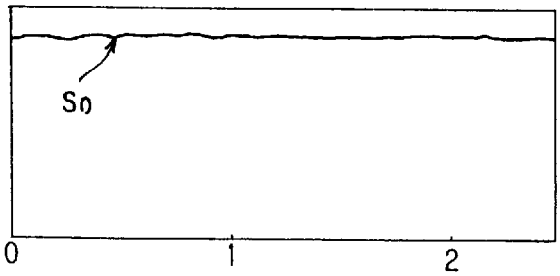

FIG. 11 is a flow chart showing the subroutine for the calculation of the KFB in detail.

The program starts at S400 in which it is checked whether the bit of the flag FKSTR is set to 1, in other words, a determination is made whether it is in the STR controller operation region. Since this flag bit was reset to 0 at S304 of the flow chart of FIG. 10, the result in this step is NO and program proceeds to S402 in which it is checked whether the flag bit was set to 1 in the preceding control cycle, i.e., it is confirmed whether it was in the STR controller operation region. The result here is naturally NO, and the program proceeds to S404 in which the feedback correction coefficient KLAF is calculated by the PID controller using the PID control law in the manner described earlier.

The feedback correction coefficient KLAF is calculated as follows.

First, the control error DKAF(k) between the desired air/fuel ratio KCMD(k−d') and the detected air/fuel ratio KACT(k) is calculated as:

$$DKAF(k) = KCMD(k-d') - KACT(k)$$

Next, the control error DKAF(k) is multiplied by predetermined gains or coefficients KP, KI, KD to obtain variables, i.e., the P (proportional) term KLAFP(k), I (integral) term KLAI(k) and the D (derivative or differential) term KLAFD(k) as:

$$KLAFP(k)=DKAF(K)\times KP$$

$$KLAFI(k)=KLAFI(k-1)+DKAF(k)\times KI$$

$$KLAFD(k)=(DKAF(k)-DKAF(k-1))\times KD$$

Thus, the P term is calculated by multiplying the error by the proportional gain KP, the I term is calculated by adding the value of KLAFI(k−1) to the product of the error and the integral gain KI, and the D term is calculated by multiplying the difference between the current control difference and the preceding control difference by the derivative gain KD. The gains KP, KI and KD are calculated based on the engine speed and the engine load. Specifically, they are calculated by retrieving from mapped data using the engine speed Ne and the manifold absolute pressure Pb.

Finally, the P, I and D terms are summed and the sum is determined as the current PID feedback correction coefficient KLAF(k) based on the PID control law as:

$$KLAF(k)=KLAFP(k)+KLAFI(k)+KLAFD(k)$$

Here, it should be noted that the offset of 1.0 is assumed to be included in the I term KLAFI(k) such that the feedback correction coefficient is a multiplication coefficient. Simply saying this, the I term KLAFI(k) is given an initial value of 1.0. It should also be noted that when the PID correction coefficient KLAF is selected, the STR controller holds the adaptive parameters such that the adaptive correction coefficient KSTR is 1.0 (initial value) or thereabout.

Returning to the explanation of FIG. 10, the program proceeds to S308 in which the PID feedback correction coefficient KLAF(k) is selected or determined as the feedback correction coefficient KFB.

When it is found in S300 that open-loop control was not in effect in the preceding control cycle, the program proceeds to S310 in which the difference DKCMD between KCMD(k−d') (the value in the control cycle earlier delayed by the dead time ) and KCMD(k) (the value in the current control cycle) is calculated and is compared with a reference value DKCMDref. When the difference DKCMD is found to exceed the reference value DKCMDref, the program advances to S302 where the PID correction coefficient KLAF is calculated using the PID control law. This is because when the change in the desired air/fuel ratio is large, a situation similar to that when fuel cutoff is resumed might arise. Specifically, the detected value probably does not indicate the true value due to air/fuel ratio detection delay and the like, so that, similarly, the controlled variable may become unstable.

On the other hand, when S310 finds the difference DKCMD to be equal to or smaller than reference value DKCMDref, the program proceeds to S312 in which the counter value C is incremented. At S314 a determination is made whether the engine coolant temperature TW is less than a prescribed value TWSTR-ON. When the detected engine coolant temperature TW is found to be below the prescribed value TWSTR-ON, the program proceeds to S304 such that the feedback correction coefficient is calculated using the PID control law. The reason for this is that the combustion is unstable at low coolant temperatures, making it impossible to obtain a stable detection of the value KACT due to misfiring and the like. Although not shown, for the same reason, the same will be applied when the coolant temperature is abnormally high.

If S314 finds that the engine coolant temperature TW is not lower than the prescribed value TWSTR-ON, the program advances to S316 in which it is checked whether the detected engine speed Ne is at or above a prescribed value NESTRLMT. When S316 finds that the detected engine speed Ne is at or above the prescribed value NESTRLMT, the program proceeds to S304 where the feedback correction coefficient is calculated using the PID control law. This is because during high-speed engine operation there tends to be insufficient time for calculation using the STR controller and, moreover, combustion is unstable.

When S316 finds that the detected engine speed Ne is lower than the prescribed value NESTRLMT, the program proceeds to S318 in which a check is made to determine which valve timing characteristic is selected in the variable valve timing mechanism 300. If the high engine-speed side characteristic HiV/T is selected, the program proceeds to S304 where the PID controller is used. This is because the large amount of valve timing overlap present when the high engine-speed side valve timing characteristic is selected, is likely to cause intake air blowby (escape of intake air through the exhaust valve), in which case the detected value KACT is not likely to be stable.

When S318 determines that the low engine-speed side characteristic LoV/T is selected (this includes the condition in which one of two intake valves is being rested), the program proceeds to S320 in which it is checked whether the engine is idling. If the result is YES, the program goes to S304 where the PID controller is used. This is because the generally stable operating condition during idling obviates the need for a high gain such as that calculated according to the adaptive control law.

When S320 determines that the engine is not idling, the program proceeds to S322 in which it is determined whether the engine load is low. When the result is YES, the program goes to S304 for the PID controller. This is because combustion is not stable in the low engine load region.

When S322 determines that the engine load is not low, the program proceeds to S324 in which the counter value C is compared with a predetermined value, 5 for example. As long as the counter value C is found to be at or below the predetermined value, the program proceeds to S304 where the feedback correction coefficient is calculated using the PID control law. This is because the controlled variable may sometimes become unstable for a period of time due to a delay in the resumption of fuel supply due until the newly supplied fuel has been combusted and due to the delay in detection.

On the other hand, when S324 determines that counter value C exceeds the prescribed value, namely, is 6 or larger, the program proceeds to S326 in which the bit of the flag FKSTR is set to 1. At S328 the feedback correction coefficient KFB is calculated according to the subroutine of FIG. 11. In this case, the result of the check at S400 of the subroutine of FIG. 11 becomes YES and the program proceeds to S406 in which a check is made as to whether or not the bit of flag FKSTR was reset to 0 in the preceding control cycle, i.e., whether or not the engine operating condition was in the PID controller operation region in the preceding cycle.

When this is the first time that the counter value exceeded the predetermined value, the result is YES, the program proceeds to S408 in which the detected value KACT(k) is compared with a lower limit value a, e. g., 0.95. If the detected value is found to be equal to or greater than the lower limit value, the program proceeds to S410 in which the detected value is compared with an upper limit value b of, say, 1.05. When it is found to be equal to or smaller than the upper limit value, the program advances through S412

(explained later) to S414, where the adaptive correction coefficient KSTR(k) is calculated using the STR control law.

In other words, when S408 finds that the detected value is below the lower limit value a or S410 finds that the detected value exceeds the upper limit value b, the program proceeds to S404 in which the feedback correction coefficient is calculated using the PID control law. To be more specific, a switch is made from PID control to STR (adaptive) control when the engine operating condition is in the STR controller operation region and the detected value KACT is 1 or in the vicinity thereof. This enables the smoothly switch from PID control to STR (adaptive) control.

When S410 determines that the detected air/fuel ratio KACT(k) is at or below the upper limit value b, the program proceeds to S412 in which, as shown, the aforesaid scalar quantity bo (the element determining the gain of the STR controller) is set to or replaced with the value obtained by dividing the same by KLAF(k−1) (the value of the PID correction coefficient in the preceding control cycle). At S414 the feedback correction coefficient KSTR(k) determined by the STR controller is calculated.

In other words, the STR controller basically calculates the feedback correction coefficient KSTR (k) in accordance with Eq. 12 as explained earlier. When the result in S406 is affirmative and the program proceeds to S408 and the succeeding steps, however, this means that the feedback correction coefficient was calculated using the PID control in the preceding control cycle. As explained earlier with reference to the configuration of FIG. 6, moreover, the feedback correction coefficient KSTR is fixed at 1.0 and the STR controller operation is kept discontinued when feedback correction coefficient is determined using the PID control law. Saying this in other words, the adaptive parameters $\hat{\theta}(k)$ in vector are determined such that KSTR=1.0. When determination of the feedback correction coefficient KSTR using the STR control law is resumed, therefore, the controlled variable becomes unstable if the value of KSTR deviates greatly from 1.0.

In light of this, if the scalar quantity $b_0$ (one of the controller parameters that are held by the STR controller such that the adaptive correction coefficient KSTR is fixed at 1.0 (initial value ) or thereabout) is divided by the last PID feedback correction coefficient, as can be seen from Eq.15, since the first term is 1.0, the second term KLAF(k−1) becomes the current correction coefficient KSTR (k), when the adaptive parameters are held such that KSTR=1.0 as just mentioned:

$$KSTR(k) = \left[\frac{KCMD(k-d') - s_0 \times y(k) - r_1 \times KSTR(k-1) - r_2 \times KSTR(k-2) - r_3 \times KSTR(k-3)}{b_0}\right] \times KLAF(k-1) = 1 \times KLAF(k-1) = KLAF(k-1) \quad \text{Eq. 15}$$

As a result, the switch from PID control to STR control can be made more smoothly.

In the subroutine of FIG. 11, when S402 determines that the engine operating condition was in the STR controller operation region in the preceding control cycle, the program goes to S416 in which the value of KSTR(k−1) (the adaptive correction coefficient in the preceding control cycle) is set to or replaced with the value of 25 KLAFI(k−1) (the I term of the PID correction coefficient in the preceding cycle). As a result, when KLAF(k) is calculated in S404, the I term KLAFI thereof becomes:

$$KLAFI(k)=KSTR(k-1)+DKAF(k)\times KI$$

and the calculated I term is added to the P term and the D term to obtain KLAF(k).

By using the value of KSTR to determine the initial value of the PID correction coefficient in the foregoing manner, the difference between the correction coefficients KSTR(k−1) and KLAF(k) can be kept small when switching from STR control to PID control. Thus, the difference between the feedback correction coefficients can be kept small and the transition can be made smoothly and continuously.

When S400 in the subroutine of FIG. 11 determines that the engine operating condition is in the STR controller operation region and S406 determines that the operating condition was not in the PID controller operation region in the preceding control cycle either, the program goes to S414 in which the feedback correction coefficient KSTR(k) is calculated by the STR controller. This calculation is made in accordance with Eq. 12 as explained earlier.

Returning to FIG. 10, the program proceeds to S330 in which it is checked whether the correction coefficient calculated by the subroutine of FIG. 11 is KSTR, and when it is, the program proceeds to S332 in which the difference between 1.0 and KSTR(k) is calculated and its absolute value is compared with a threshold value KSTRref. Wild fluctuations of the feedback correction coefficient cause sudden changes in the controlled variable and degrades control stability. Accordingly, the absolute value of the difference between 1.0 and the feedback correction coefficient is compared with the threshold value and when it exceeds the threshold value, the program proceeds to S304 where a new feedback correction coefficient is determined using the PID control. On the other hand, when S332 determines that the absolute value of the difference between 1.0 and the calculated feedback correction coefficient KSTR (k) does not exceed the threshold value, the program proceeds to S334 in which the value KSTR(k) determined by the STR controller is set as the feedback correction coefficient KFB. When the result in S330 is NO, the program proceeds to S336 in which the bit of the flag FKSTR is reset to 0. At S338 the value KLAF(k) determined by the PID controller is set as the feedback correction coefficient KFB.

Returning to the flow chart of FIG. 4, the program proceeds to S34 in which the required amount of fuel supply Tcyl(k) is multiplied by the feedback correction coefficient KFB and the product is added by a value TTOTAL to determine the output amount of fuel injection Tout(k). The value TTOTAL is the total value of various corrections such as a correction for adjusting for atmospheric pressure to be made by addition, but does not include the dead time of the fuel injector 22 (which is separately added at the time of outputting the output amount of fuel supply Tout(k)).

The program then proceeds to S36 in which the output amount of fuel supply Tout(k) is corrected for fuel adhering on the wall of the intake manifold 22 to determine the amount of fuel supply Tout-F(k) corrected by fuel adhesion. Since, however, correcting for fuel adhesion is described in Japanese Patent Application No. Hei 7(1995)-354,046 proposed by the assignee and the gist of the invention does not reside in this feature, no detailed explanation is made herein. The program proceeds to S38 in which the output amount of fuel supply Tout-F(k) is applied to the fuel injector 22 as the manipulated variable.

When S16 determines that the fuel supply is discontinued, the program proceeds to S40 in which the output amount of fuel supply Tout-F(k) is made zero. If the result in S22 or S24 is negative, since this means that the air/fuel ratio should be controlled in the open-loop manner, the program proceeds to S42 in which the feedback correction coefficient is 1.0. At S34 the output amount of fuel supply Tout(k) is determined. If S14 determines that the engine is cranking, the program proceeds to S44 in which the amount of fuel supply at engine cranking Ticr is determined by retrieving mapped data using the engine coolant temperature and a similar parameter. At S46 the output amount of fuel supply Tout(k) is calculated using the retrieved value based on an equation at engine cranking.

With the above arrangement, since the controlled variable y is determined based on the detected air/fuel ratio KACT and a desired air/fuel ratio KCMD such that the desired value r is a predetermined value, e.g., a fixed or constant value, it becomes possible to decrease the number of control parameters or variables. In the former system illustrated in FIG. 14, the two inputs, the desired value r (desired air/fuel ratio KCMD) and the controlled variable y (detected air/fuel ratio KACT) were variables. Since the order of control was 2nd order, this resulted in the degradation of control.

On the other hand, in the invention of the present system, the control parameter is limited to only one variable by making the desired value as a predetermined or fixed value. In other words, the system is configured such that the desired air/fuel ratio and the desired value of the adaptive controller is made separate and independent, while the desired value r is made constant. As a result, the control is decreased to a first order and the control stability is greatly enhanced. With the above arrangement, when the desired air/fuel ratio is determined in response to the operating conditions of the engine, or when the desired air/fuel ratio is slightly corrected in the catalyst window in response to the output of the $O_2$ sensor so as to maximize the catalyst purification efficiency, the adaptive parameters fluctuate very little. The fuel supply amount correction coefficient calculated using the adaptive parameters accordingly becomes a stable value, enabling the air/fuel ratio control to be enhanced and the adaptive controller stability to be improved.

Moreover, when the air/fuel ratio closed-loop control is resumed upon completion of the open-loop control at the time of, for example returning from fuel cutoff, since the feedback correction coefficient is determined using the PID control law for a predetermined period, the control stability is not likely to be degraded. On the other hand, since the period is set to be a limited time, it is possible to use the feedback correction coefficient using the adaptive law calculated in the STR controller to eliminate the control error between the desired and detected air/fuel ratios at one time, thereby enhancing the control convergence.

Furthermore, since smooth switching between the adaptive or STR control and the PID control is effected, no level difference exists between the correction coefficients, resulting in no sudden change in the manipulated variable. No oscillation or divergence in the controlled variable happens and the control stability is effectively prevented from being degraded.

It should be noted that it is alternatively possible to provide a third catalyst 94 at a location shown by a phantom line 400 in FIG. 5 and upstream of the LAF sensor 54. The third catalyst 94 may preferably be a light-off catalyst that is able to be activated in a relatively short period.

Figure 13:
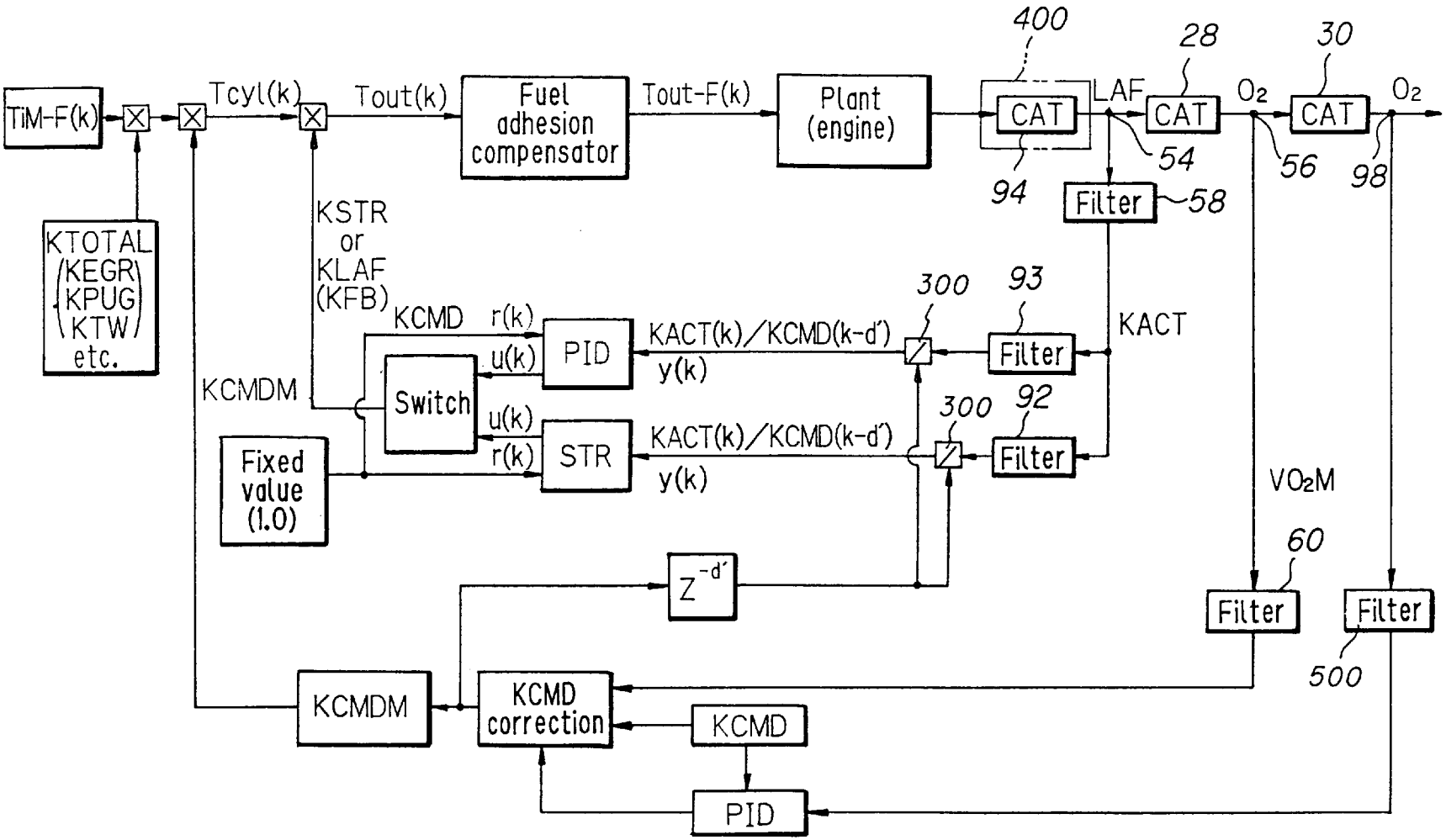
FIG. 13 is a view, similar to FIG. 5, but showing the system according to a second embodiment of the invention.

FIG. 13 is a view, similar to FIG. 5, but showing the configuration of the system according to a second embodiment of the invention.

As illustrated in FIG. 13, a second $O_2$ sensor 98 is provided downstream of the second catalyst 30. The output of the second $O_2$ sensor 98 is, as shown, used to correct the desired air/fuel ratio KCMD. With this arrangement, it becomes possible to correct the air/fuel ratio KCMD more optimally, thereby enhancing the air/fuel control more effectively.

Moreover, since the air/fuel ratio in the exhaust gas finally exhausted in the air is detected by the second $O_2$ sensor 98, emission control is improved. This configuration also makes it possible to monitor whether the upstream catalysts become degraded. The second $O_2$ sensor 98 can be used as a substitution of the first $O_2$ sensor 56. The filter 500 connected to the second $O_2$ sensor 98 should preferably be a filter having the cutout frequency of 1000 Hz.

In the first and second embodiments, although the $O_2$ sensor is used as the exhaust gas sensor for correcting the desired air/fuel ratio, it is alternatively possible to a NOx sensor that detects the NOx component in the exhaust gas, or a CO sensor that detects the CO component in the exhaust gas, or a HC sensor that detects the HC components in the exhaust gas. This is because these sensors can be used, similar to the $O_2$ sensor, for correcting the desired air/fuel ratio in response to the detected component in the exhaust gas so as to maximize the catalyst purification efficiency.

It should also be noted that, although the system is configured in the foregoing embodiments such that the STR controller is provided for calculating the feedback correction coefficient and in addition, the PID controller is provided for calculating the coefficient using the PID control law, the configuration is not indispensable in the invention and it suffices if only the STR controller is present.

It should further be noted that, although the amount of fuel supply is not feedback-controlled for individual cylinders, it is alternatively possible to provide an observer that estimates each cylinder air/fuel ratios from the output of the single LAF sensor and based on the estimated individual cylinder air/fuel ratios, to determine the correction coefficients for the individual cylinders such that the deviation in the respective cylinders is decreased such that the air/fuel ratio or the amount of fuel supply is controlled separately for respective cylinders, as is described in Japanese Laid-Open Patent Application No. Hei 6(1994)-17681 previously proposed by the assignee. It should further be noted that the air/fuel ratio or the amount of fuel supply is controlled in each cylinder by providing the LAF sensor 54 for each cylinder to detect each cylinder air/fuel ratio.

It should further be noted that, although the throttle valve 16 is operated by a stepper motor in the foregoing embodiments, it can instead be applied by being mechanically linked with the accelerator pedal and can be directed operated in response to accelerator pedal depression.

It should further be noted that, although the air/fuel ratio is expressed in the equivalence ratio in the foregoing embodiments, it can instead be determined in terms of the air/fuel ratio itself.

It should further be noted that, although the feedback correction coefficients are determined as values to be multiplied in the foregoing embodiments, it can instead be obtained as values to be added.

It should further be noted that, although the STR-type adaptive controller is used, the adaptive controller can instead be configured as the Model References Adaptive Control System.

Although the invention has thus been shown and described with reference to specific embodiments, it should be noted that the invention is in no way limited to the details of the described arrangements, but changes and modifications may be made without departing from the scope of the invention, which is defined by the appended claims.

What is claimed is:

1. A system for controlling an air/fuel ratio of an internal combustion engine, comprising:

an air/fuel ratio detecting means for detecting an air/fuel ratio of exhaust gas generated by the engine at least based upon an output of an air/fuel ratio sensor located in an exhaust system of the engine;

engine operating condition detecting means for detecting engine operating conditions including at least engine speed and engine load;

basic fuel supply amount calculating means for calculating a basic amount of fuel supply to be supplied to the engine based upon at least the detected engine operating conditions;

desired value predetermining means for predetermining a desired value as a fixed value;

controlled variable determining means for determining a controlled variable based upon the detected air/fuel ratio and a desired air/fuel ratio as at least one of a) a ratio between the detected air/fuel ratio and the desired air/fuel ratio and b) a difference between the detected air/fuel ratio and the desired air/fuel ratio such that the desired value is the fixed value;

feedback correction coefficient calculating means operatively coupled to said air/fuel ratio detecting means and having an adaptive controller which receives as inputs the desired value and the controlled variable and an adaptation mechanism which estimates adaptive parameters, said feedback correction coefficient calculating means for calculating a feedback correction coefficient as an output based upon at least the adaptive parameters for correcting the basic amount of fuel supply calculated by said basic fuel supply amount calculating means such that the controlled variable converges to the desired value;

output fuel amount determining means, operatively coupled to said basic fuel amount calculating means and feedback correction coefficient calculating means, for correcting the basic amount of fuel supply calculated by said basic fuel supply amount calculating means by the feedback correction coefficient to determine an output amount of fuel supply; and fuel supplying means, operatively coupled to said output fuel amount determining means, for supplying the output amount of fuel supply to the engine.

2. A system according to claim 1, further including:

a catalyst located at the exhaust system of the engine downstream of the air/fuel ratio sensor;

a second air/fuel ratio sensor located at the exhaust system of the engine downstream of the catalyst, said second air/fuel ratio sensor detecting concentration of a component in the exhaust gas generated by the engine; and desired air/fuel ratio determining means for determining the desired air/fuel ratio based upon at least an output of the second air/fuel ratio sensor.

3. A system according to claim 2, wherein said controlled variable determining means determines the controlled variable to be the ratio between the detected air/fuel ratio and the desired air/fuel ratio such that the desired value is 1.0.

4. A system according to claim 2, wherein said desired air/fuel ratio determining means includes:

basic desired air/fuel ratio determining for determining a basic value of the desired air/fuel ratio based upon at least the detected engine operating conditions;

correction value calculating means for calculating a correction value for correcting the basic value based upon the output of the second air/fuel ratio sensor; and desired air/fuel ratio calculating means for calculating the desired air/fuel ratio based upon at least the basic value and the correction value.

5. A system according to claim 1, wherein said controlled variable determining means determines the controlled variable to be the ratio between the detected air/fuel ratio KACT and the desired air/fuel ratio such that the desired value is 1.0.

6. A system according to claim 1, wherein said controlled variable determining means determines the controlled variable to be the difference between the detected air/fuel ratio and the desired air/fuel ratio such that the desired value is 0.

7. A computer program controlled system for controlling an air/fuel ratio of an internal combustion engine, comprising:

an air/fuel ratio detecting means for detecting an air/fuel ratio of exhaust gas generated by the engine based upon at least an output of an air/fuel ratio sensor located in an exhaust system of the engine;

engine operating condition detecting means for detecting engine operating conditions including at least engine speed and engine load;

basic fuel supply amount calculating means for calculating a basic amount of fuel supply to be supplied to the engine based upon at least the detected engine operating conditions;

desired value predetermining means for predetermining a desired value as a fixed value;

controlled variable determining means for determining a controlled variable based upon the detected air/fuel ratio and a desired air/fuel ratio as at least one of a) a ratio between the detected air/fuel ratio and the desired air/fuel ratio and b) a difference between the detected air/fuel ratio and the desired air/fuel ratio such that the desired value is the fixed value;

feedback correction coefficient calculating means operatively coupled to said air/fuel ratio detecting means and having an adaptive controller which receives as inputs the desired value and the controlled variable and an adaptation mechanism which estimates adaptive parameters, said feedback correction coefficient calculating means for calculating a feedback correction coefficient as an output based upon at least the adaptive parameters for correcting the basic amount of fuel supply calculated by said basic fuel supply amount calculating means such that the controlled variable converges to the desired value;

output fuel amount determining means, operatively coupled to said basic fuel amount calculating means and feedback correction coefficient calculating means, for correcting the basic amount of fuel supply calculated by said basic fuel supply amount calculating means by the feedback correction coefficient to determined an output amount of fuel supply; and fuel supply means, operatively coupled to said output fuel amount determining means, for supplying the output amount of fuel supply to the engine.

8. A system according to claim 7, further including:

a catalyst located at the exhaust system of the engine downstream of the air/fuel ratio sensor;

a second air/fuel ratio sensor located at the exhaust system of the engine downstream of the catalyst, said second air/fuel ratio sensor detecting concentration of a component in the exhaust gas generated by the engine; and desired air/fuel ratio determining means for determining the desired air/fuel ratio based upon at least an output of the second air/fuel ratio sensor.

9. A system according to claim 8, wherein said controlled variable determining means determines the controlled variable to be the ratio between the detected air/fuel ratio and the desired air/fuel ratio such that the desired value is 1.0.

10. A system according to claim 8, wherein said desired air/fuel ratio determining means includes:

basic desired air/fuel ratio determining for determining a basic value of the desired air/fuel ratio based at least upon the detected engine operating conditions;

correction value calculating means for calculating a correction value for correcting the basic value based upon the output of the second air/fuel ratio sensor; and desired air/fuel ratio calculating means for calculating the desired air/fuel ratio based at least upon the basic value and the correction value.

11. A system according to claim 7, wherein said controlled variable determining means determines the controlled variable to be the ratio between the detected air/fuel ratio and the desired air/fuel ratio such that the desired value is 1.0.

12. A system according to claim 7, wherein said controlled variable determining means determines the controlled variable to be the difference between the detected air/fuel ratio and the desired air/fuel ratio such that the desired value is 0.

13. A method for controlling an air/fuel ratio of an internal combustion engine, comprising the steps of:

detecting an air/fuel ratio of exhaust gas generated by the engine based upon at least an output of an air/fuel ratio sensor located in an exhaust system of the engine;

detecting engine operating conditions including at least engine speed and engine load;

calculating a basic amount of fuel supply to be supplied to the engine based upon at least the detected engine operating conditions;

predetermining a desired value as a fixed value;

determining a controlled variable based upon the detected air/fuel ratio and a desired air/fuel ratio as at least one of a) a ratio between the detected air/fuel ratio and the desired air/fuel ratio and b) a difference between the detected air/fuel ratio and the desired air/fuel ratio such that the desired value is the fixed value;

calculating a feedback correction coefficient using an adaptive controller which receives as inputs the desired value and the controlled variable and an adaptation mechanism which estimates adaptive parameters, based at least upon the adaptive parameters for correcting the basic amount of fuel supply such that the controlled variable converges to the desired value;

correcting the basic amount of fuel supply by the feedback correction coefficient to determine an output amount of fuel supply; and supplying the output amount of fuel supply to the engine.

14. A method according to claim 13, further comprising the step of:

determining the desired air/fuel ratio based upon at least an output of a second air/fuel ratio sensor located at the exhaust system of the engine downstream of a catalyst, which is located downstream of the air/fuel ratio sensor, said second air/fuel ratio sensor detecting concentration of a component in the exhaust gas generated by the engine.

15. A method according to claim 14, further comprising the step of:

determining the controlled variable to be the ratio between the detected air/fuel ratio and the desired air/fuel ratio such that the desired value is 1.0.

16. A method according to claim 14, further comprising the steps of:

determining a basic value of the desired air/fuel ratio based upon at least the detected engine operating conditions;

calculating a correction value for correcting the basic value based upon the output of the second air/fuel ratio sensor; and determining the desired air/fuel ratio based upon at least the basic value and the correction value.

17. A method according to claim 13, further comprising the step of:

determining the controlled variable to be the ratio between the detected air/fuel ratio and the desired air/fuel ratio such that the desired value is 1.0.

18. A method according to claim 13, further comprising the step of:

determining the controlled variable to be the difference between the detected air/fuel ratio and the desired air/fuel ratio such that the desired value is 0.

19. A computer program embodied on a computer-readable medium for controlling an air/fuel ratio of an internal combustion engine, said computer program comprising the steps of:

detecting an air/fuel ratio of exhaust gas generated by the engine based upon at least an output of an air/fuel ratio sensor located in an exhaust system of the engine;

detecting engine operating conditions including at least engine speed and engine load;

calculating a basic amount of fuel supply to be supplied to the engine based upon at least the detected engine operating conditions;

predetermining a desired value as a fixed value;

determining a controlled variable based upon the detected air/fuel ratio and a desired air/fuel ratio as at least one of a) a ratio between the detected air/fuel ratio and the desired air/fuel ratio and b) a difference between the detected air/fuel ratio and the desired air/fuel ratio such that the desired value is the fixed value;

calculating a feedback correction coefficient using an adaptive controller which receives as inputs the desired value and the controlled variable and an adaptation mechanism which estimates adaptive parameters, based at least upon the adaptive parameters for correcting the basic amount of fuel supply such that the controlled variable converges to the desired value;

correcting the basic amount of fuel supply by the feedback correction coefficient to determine an output amount of fuel supply; and supplying the output amount of fuel supply to the engine.

20. A computer program according to claim 19, further comprising the step of:

determining the desired air/fuel ratio based upon at least an output of a second air/fuel ratio sensor located at the exhaust system of the engine downstream of a catalyst, which is located downstream of the air/fuel ratio sensor, said second air/fuel ratio sensor detecting concentration of a component in the exhaust gas generated by the engine.

21. A computer program according to claim 20, further comprising the step of:

determining the controlled variable to be the ratio between the detected air/fuel ratio and the desired air/fuel ratio such that the desired value is 1.0.

22. A computer program according to claim 20, further comprising the steps of:

determining a basic value of the desired air/fuel ratio based upon at least the detected engine operating conditions;

calculating a correction value for correcting the basic value based upon the output of the second air/fuel ratio sensor; and determining the desired air/fuel ratio based upon at least the basic value and the correction value.

23. A computer program according to claim 19, further comprising the step of:

determining the controlled variable to be the ratio between the detected air/fuel ratio and the desired air/fuel ratio such that the desired value is 1.0.

24. A computer program according to claim 19, further comprising the step of:

determining the controlled variable to be the difference between the detected air/fuel ratio and the desired air/fuel ratio such that the desired value is 0.

* * * * *